US005186618A

United States Patent [19]

Shike et al.

[11] Patent Number: 5,186,618

[45] Date of Patent: Feb. 16, 1993

[54] GAS LIGHTER WITH SAFETY DEVICE

[75] Inventors: Tsutomu Shike; Toshihiko Eguchi; Yosimitu Kaga; Kazuhiko Suganuma, all of Shimohara, Japan

[73] Assignee: Tokai Corporation, Yokohama, Japan

[21] Appl. No.: 770,111

[22] Filed: Oct. 2, 1991

[30] Foreign Application Priority Data

| | | | |
|---|---|---|---|
| Oct. 3, 1990 | [JP] | Japan | 2-104222[U] |
| Nov. 30, 1990 | [JP] | Japan | 2-130580[U] |
| Jan. 11, 1991 | [JP] | Japan | 3-000582[U] |
| Sep. 30, 1991 | [JP] | Japan | 3-251396 |

[51] Int. Cl.[5] ..... F23D 11/36

[52] U.S. Cl. ..... 431/153; 431/276

[58] Field of Search ..... 431/153, 254, 276, 277

[56] References Cited

U.S. PATENT DOCUMENTS

| | | | |
|---|---|---|---|
| 3,898,031 | 8/1975 | Rusakowicz . | |
| 4,784,602 | 11/1988 | Nitta . | |
| 4,786,248 | 11/1988 | Nitta . | |
| 4,832,596 | 5/1989 | Morris, Sr. . | |
| 4,859,172 | 8/1989 | Nitta . | |
| 5,002,482 | 3/1991 | Fairbanks et al. . | |
| 5,074,781 | 12/1991 | Fujita | 431/153 |
| 5,090,893 | 2/1992 | Floriot | 431/153 |
| 5,092,764 | 3/1992 | McDonough et al. | 431/153 |

FOREIGN PATENT DOCUMENTS

| | | | |
|---|---|---|---|
| 62-080244 | 11/1987 | Japan . | |
| 62-180247 | 11/1987 | Japan . | |
| 63-142562 | 9/1988 | Japan . | |
| 1-178456 | 12/1989 | Japan . | |
| 3-25215 | 2/1991 | Japan . | |
| 3-501647 | 4/1991 | Japan . | |
| WO9000239 | 11/1990 | World Int. Prop. O. | 431/277 |

*Primary Examiner*—Carroll B. Dority

*Attorney, Agent, or Firm*—Brumbaugh, Graves, Donohue & Raymond

[57] ABSTRACT

A gas lighter with a safety device has a lock member which is able to linearly move between a locking position where it prevents depression of a valve lever and a releasing position where it allows depression of the valve lever and is urged to the locking position. A holding member hold the lock member in the releasing position in response to movement of the lock member to the releasing position, and a releasing member releases the lock member from the holding member in response to depression of the valve lever, thereby permitting the lock member to move away from the releasing position. A temporary holding member temporarily holds the lock member in the releasing position or the vicinity thereof until the valve lever returns to the original position.

26 Claims, 37 Drawing Sheets

GAS LIGHTER WITH SAFETY DEVICE

BACKGROUND OF THE INVENTION

1. Field of the Invention

This invention relates to a gas lighter with a safety device, and more particularly to a so-called child resistant gas lighter having a safety device which prevents depression of the valve lever of the lighter to prevent inadvertent ignition while the gas lighter is not used.

2. Description of the Prior Art

Though a gas lighter is a convenient tool which can easily be ignited by depression of the valve lever, it is not preferable in view of safety that those who do not know proper use of the lighter like a child inadvertently ignites it.

Accordingly, there has been a demand for a so-called child resistant gas lighter which cannot be inadvertently ignited by children or the like.

There have been proposed various kinds of child resistant gas lighter. Most of the safety devices built in these child resistant gas lighter have a lock mechanism which prevents depression of the ignition lever and must be released to allow the valve lever to be depressed. However, any type of the conventional child resistant gas lighter has drawbacks in use and is desired to be improved for practical use.

For example, any one of the safety devices as disclosed in Japanese Unexamined Utility Model Publication Nos. 62(1987)-74371 (U.S. Pat. No. 4,859,172), 62(1987)-180244, 62(1987)-180247, 62(1987)-180249 (U.S. Pat. No. 4,786,248), 63(1988)-142562 and 63(1988)-142564 (U.S. Pat. No. 4,784,602) has a lock member which prevents depression of the ignition lever. The lock member is manually moved between a locking position and a releasing position, and the lock member remains in the releasing position and the safety device cannot function unless the lock member is manually returned to the locking position after it is moved to the releasing position and the the gas lighter is ignited. That is, the lock mechanism must be operated again after it is released and the lighter is used. Otherwise, the lock mechanism cannot function. Thus there has been a demand for a further improved lock mechanism.

There has been proposed a safety device having a so-called auto-return function for automatically returning the lock member (which prevents depression of the ignition lever) to the locking position in response to the igniting operation of the gas lighter after movement of the lock member to the releasing position. For example, those disclosed in Japanese Patent Publication of Translated Version (PCT) No. 3(1991)-1050 (U.S. Pat. No. 5,002,482), Japanese Unexamined Patent Publication No. 3(1991)-25215 and U.S. Pat. No. 3,898,031 have such an auto-return function. However, either of these safety devices has drawbacks for practical use that release of the lock mechanism involves a motion of a finger along an L-shaped path, which adversely affects ease of releasing the lock mechanism in the gas lighter which is generally operated with a single finger, e.g. the thumb, and leads to different results depending on persons who use the lighter. Further, in the safety device disclosed in the former patent publication, the lock member is formed of resilient material and accordingly, the lock member can return to the locking position under its own resiliency after it is moved to the releasing position.

Though there have been proposed safety devices in which the lock mechanism is released by a motion of a finger along a path in the form of a simple line, not L-shaped, any one of them has drawbacks for practical use. For example, in the safety device disclosed in Japanese Patent Publication of Translated Version (PCT) No. 3(1991)-501647, a part of a lock member which is formed of spring is moved along an arcuate path to the releasing position and held there. However, in the safety device, the arrangement for guiding release of the spring-like lock member is not satisfactory and accordingly the lock member cannot be steadily released, which adversely affects ease of releasing the lock mechanism in the gas lighter which is generally operated with a single finger, e.g. the thumb, and leads to different results depending on persons who use the lighter as in the preceding example. Further, since the lock member is formed of spring, the lock member can deform to cause failure of the lock mechanism after repeated use of the lighter.

In the safety device disclosed in U.S. Pat. No. 4,832,596, the lock member is moved along a linear path to the releasing position but it automatically returns to the locking position unless it is held with a finger other than the finger with which the ignition mechanism is actuated. Accordingly, in the safety device, the lock member cannot be steadily released, which adversely affects ease of releasing the lock mechanism in the gas lighter which is generally operated with a single finger, e.g. the thumb, and leads to different results depending on persons who use the lighter as in the preceding examples.

In order to overcome such problems, there has been proposed an auto-return safety device in which the lock member is moved along a linear path to the releasing position, thereby facilitating release of the lock mechanism, and at the same time, it can be held in the releasing position with the finger with which the ignition mechanism is actuated, without using another finger. However, the safety device also has drawbacks for practical use. That is, in the safety device disclosed in the Japanese Unexamined Utility Model Publication No. 1(1989)-178456, the lock member is incorporated in the ignition lever, which is actuated to ignite the lighter, so that the lock member can be moved to the releasing position with the thumb for operating the ignition lever, and the ignition lever is actuated with the thumb after the lock member is moved to the releasing position with the thumb. Thus in the safety device, release of the lock mechanism is facilitated. However, the safety device is disadvantageous in that when the ignition lever is actuated with the thumb after the lock member is moved to the releasing position with the same finger, the lock member can be inadvertently released from the thumb and can return to the locking position. Accordingly, also in the safety device, the lock member cannot be steadily released, which adversely affects ease of releasing the lock mechanism in the gas lighter which is generally operated with a single finger, e.g. the thumb, and leads to different results depending on persons who use the lighter as in the preceding examples.

As can be understood from the description above, any one of the conventional child resistant safety device has drawbacks for practical use, and accordingly there has been a demand for a child resistant safety device which has an enhanced safety and is easy to handle.

Further, in manufacture of gas lighters having such a safety device, it is required to rationalize the assembling steps, to improve assembling accuracy thereby further facilitating handling of the safety device and to reduce the manufacturing cost.

SUMMARY OF THE INVENTION

In view of the foregoing observations and description, the primary object of the present invention is to provide a gas lighter with a safety device which is excellent both in ease of handling and in safety function and which has an auto-return lock mechanism which can be automatically restored without operation after it is released and the lighter is ignited, the ease of handling being improved by arranging the lock mechanism so that the lock mechanism is released by movement of a lock member along a linear path to a releasing position and the lock member is automatically held in the releasing position to permit the user to actuate the ignition mechanism with either the finger which has been used to release the lock mechanism or any finger else independently from action of releasing the lock mechanism.

Another object of the present invention is to provide a gas lighter with a safety device which is further improved in stability and ease of handling in the locked state.

Still another object of the present invention is to provide a gas lighter with a safety device which permits rationalization of the assembling steps, improvement in assembling accuracy of the safety device thereby further facilitating handling of the safety device and reduction of the manufacturing cost.

The gas lighter with a safety device in accordance with the present invention is characterized by having a lock member which is able to linearly move between a locking position where it prevents depression of a valve lever and a releasing position where it allows depression of the valve lever and is urged to the locking position, a holding means which is caused to hold the lock member in the releasing position in response to movement of the lock member to the releasing position, a releasing means which releases the lock member from the holding means in response to depression of the valve lever, thereby permitting the lock member to move away from the releasing position, and a temporary holding means which temporarily holds the lock member in the releasing position or the vicinity thereof until the ignition lever returns to the original position.

In one preferred embodiment of the present invention, the lock member is foldable in the locking position.

In another preferred embodiment of the present invention, the gas lighter is formed of a lighter body and an intermediate casing which is formed separately from the lighter body and in which the safety device (comprising the lock member, the spring, the holding means, the releasing means and the like) and an ignition mechanism are incorporated. The safety device and the ignition mechanism are incorporated in the intermediate casing before the intermediate casing is incorporated in the lighter body.

With the safety device in accordance with the present invention, the lock lever prevents depression of the valve lever and does not permit inadvertent ignition of the lighter while the gas lighter is not used, and at the same time, it is automatically returned to the locking position after it is moved to the releasing position to permit ignition and the valve lever returns to the original position after ignition. Thus a highly safe gas lighter having an auto-return function in which the lock mechanism is automatically restored without operation after it is released and the lighter is ignited can be realized.

Further, in the gas lighter in accordance with the present invention, since the lock member is linearly moved between the locking position and the releasing position, it can be easily operated.

Further since the lock member is automatically held in the releasing position, the ignition mechanism can be actuated with either the finger which has been used to release the lock mechanism or any finger else independently from action of releasing the lock mechanism, whereby the safety and the ease of handling are both improved and the gas lighter can be operated steadily without depending on the person who uses it.

Further, in the case of the embodiment in which the lock member is foldable in the locking position, the lock member can be surely held in the locking position and at the same time ease of handling the lighter can be improved by folding the lock member in the locking position.

Further, in the case of the embodiment in which the lighter is formed of the lighter body and the intermediate casing and the intermediate casing is incorporated in the lighter body after the safety device and the ignition means is incorporated in the intermediate casing, the assembly comprising the intermediate casing and the components incorporated therein can be assembled separately from the lighter body and can be combined with the lighter body later as a unit, which affords more freedom to the assembly line in the manufacturing steps and permits rationalization of the manufacturing steps.

Further since the assembly of the intermediate casing, the safety device and the ignition means can be incorporated in the lighter body after assembled together, the assembling accuracy is improved, whereby precision of the safety device is improved and handling of the lighter is further facilitated.

In the case of the embodiment in which the lighter is formed of the lighter body and the intermediate casing, the intermediate casing may be formed of material which is less expensive than the material for forming the lighter body which must have high heat resistance and accordingly is relatively expensive, whereby the manufacturing cost of the lighter can be reduced.

DESCRIPTION OF THE PREFERRED EMBODIMENTS

Embodiments of the present invention will be described in detail with reference to the drawings. The embodiment shown in FIGS. 1 to 15 is arranged so that the lock member 4 is pushed transversely from a side of the lighter body 3.

FIGS. 1 to 3 and FIG. 10 show the state of the gas lighter in accordance with this embodiment in which the valve lever is locked.

Figure 31:
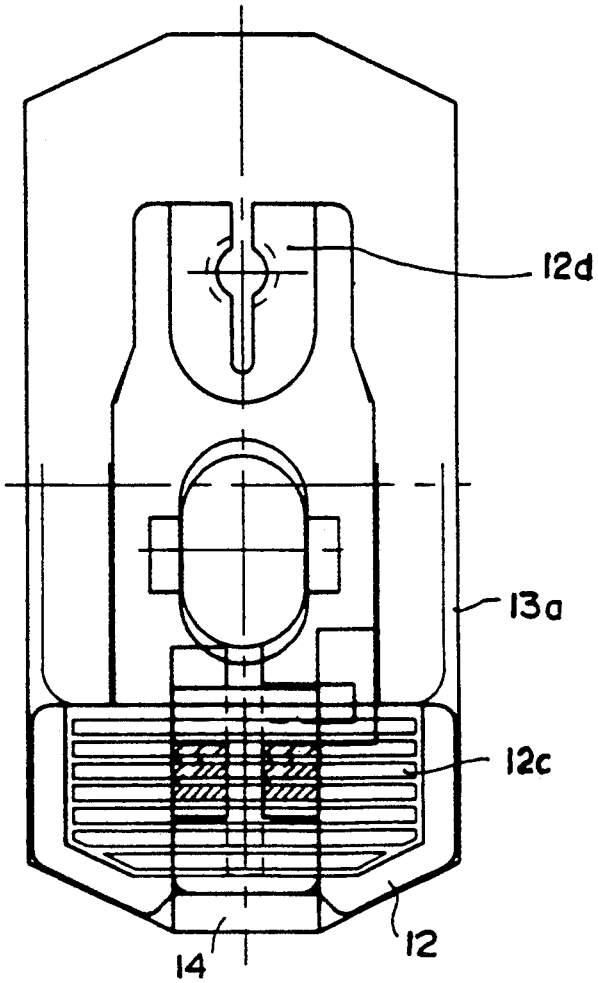
FIG. 31 is a plan view of a gas lighter in accordance with still another embodiment of the present invention.
Figure 32:
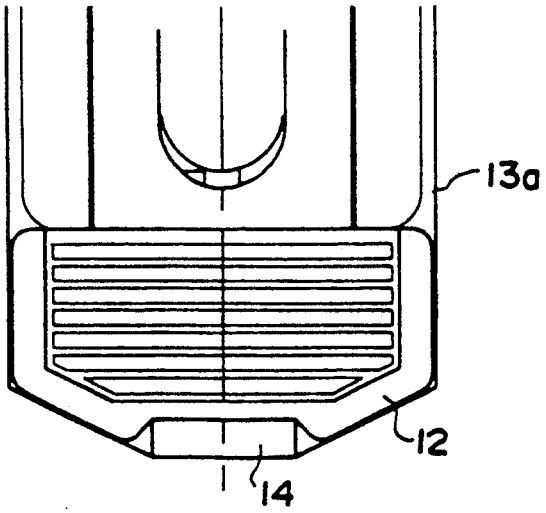
FIG. 32 is a fragmentary plan view showing the valve lever.

As shown in the figures, an ignition lever 2 which releases fuel gas and actuates an ignitor by a conventional mechanism (not shown) when it is depressed is provided with a pair of projections 2*a* and 2*b* on the lower surface thereof. The projections 2*a* and 2*b* extend downward and are obliquely spaced from each other. The valve lever 2 is formed of resin material having high heat resistance and is provided with a depressing portion 12*c* at one end and with a forked engagement portion 12*d* at the other end (FIG. 31), the forked engagement portion 12*d* being engaged with the neck of a fuel valve (not shown) so that fuel gas is discharged from the valve in response to depression of the depressing portion with a finger. The lock member 4 is provided between the valve lever 2 and the lighter body 3 to be slidable transversely to the ignition lever 2 between a locking position in which it prevents depression of the valve lever 2 and a releasing position in which it allows depression of the ignition lever 2. A hook 4*e* which is fitted in a groove 3*a* formed on the lighter body 3 and retains the lock member 4 on the lighter body 3 to be slidable thereon is formed on the lower surface of the lock member 4. (See FIG. 3)

The lock member 4 is formed of resin material which can be readily restored after deformation and is highly slidable, and has a spring-like arm 4*a* whose tip abuts against a part 5 of the lighter body 3. The lock member 4 is urged toward the locking position shown in FIGS. 1 to 3 by the arm 4*a*. In the locking position, the projection 2*a* of the valve lever 2 abuts against the upper surface 4*c* of the lock member 4 and prevents depression of the ignition lever 2, and the outer end 4*b* of the lock member 4 projects outside the lighter body 3.

When the outer end 4*b* of the lock member 4 is pushed overcoming the resiliency of the arm 4*a*, the lock member 4 moves from the locking position to the releasing position (FIGS. 4 and 5), where a cutaway portion 4*d* formed in a side wall of the lock member 4 is aligned with the projection 2*a* of the valve lever 2 to receive it when the valve lever 2 is depressed thereby permitting depression of the valve lever 2.

An engagement recess 4*f* for holding the lock member 4 in the releasing position when it is moved there is formed on the lower surface of the lock member 4. The lighter body 3 is provided with a holding member 8 which is formed in a rectangular recess 6 formed on the upper part of the lighter body 3. The holding member 8 is a cantilever-like portion which is formed integrally with the lighter body 3 to be resiliently deformed. As clearly shown in FIGS. 1 and 10, a rightangled extension 8*c* is formed on the tip of the holding member 8, and a protrusion 8*a* adapted to be engaged with the engagement recess 4*f* is formed at the corner. Further a projection 8*b* is formed on the tip of the extension 8*c* to extend upward. The projection 8*b* is positioned just below the projection 2*b* of the valve lever 2 and is pushed downward when the valve lever 2 is depressed, whereby the holding member 8 is resiliently deformed downward and the protrusion 8*a* is disengaged from the engagement recess 4*f* of the lock member 4.

The valve lever 2 is provided with an engagement portion which engages with the lock member 4 released from the holding member 8 and temporarily holds the lock member 4 in the releasing position until the ignition lever 2 moves upward from the depressed position to the position before depression. The projection 2*a* functions as the engagement portion. Though the engagement portion may be formed separately from the projection 2*a*, it is preferred that the projection 2*a* be used also as the engagement portion in view of simplification of the structure.

Figure 14:
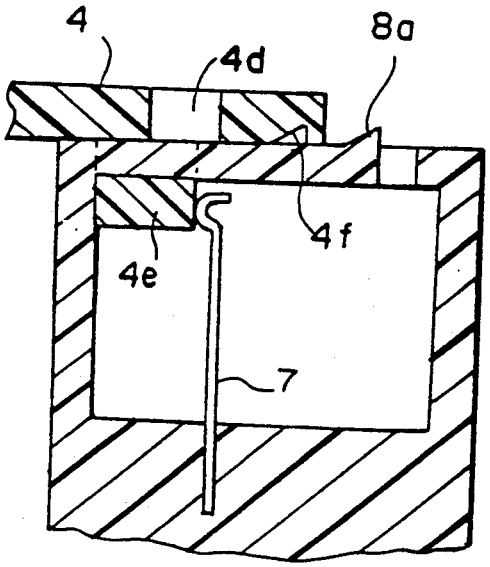
FIG. 14 is a fragmentary side cross-sectional view showing the spring-urging part of a gas lighter with a safety device in accordance with another embodiment of the present invention.
Figure 15:
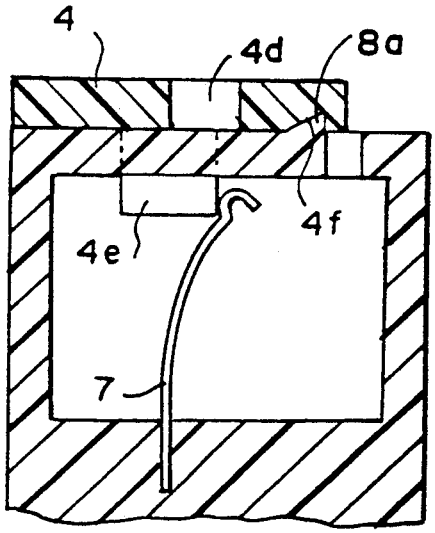
FIG. 15 is a view similar to FIG. 14 but in a different state.

As the means for urging the lock member 4 toward the locking position, a spring 7 which abuts against the hook 4*e* of the lock member 4 at one end with the other end fixed to the lighter body 3 as shown in FIGS. 14 and 15 may be used instead of the arm 4*a*.

The operation of the gas lighter in accordance with this embodiment will be described in detail, hereinbelow.

When the lighter is not used, the lock member 4 is in the locking position shown in FIGS. 1 to 3 and 10 where the outer end 4*b* of the lock member 4 projects outside the lighter body 3 and the projection 2*a* of the ignition lever 2 is in abutment against the upper surface 4*c* of the lock member 4 as described above and the ignition lever 2 cannot be depressed. Accordingly, in this state, the lighter cannot be ignited and inadvertent ignition by children or the like is prevented.

Figure 4:
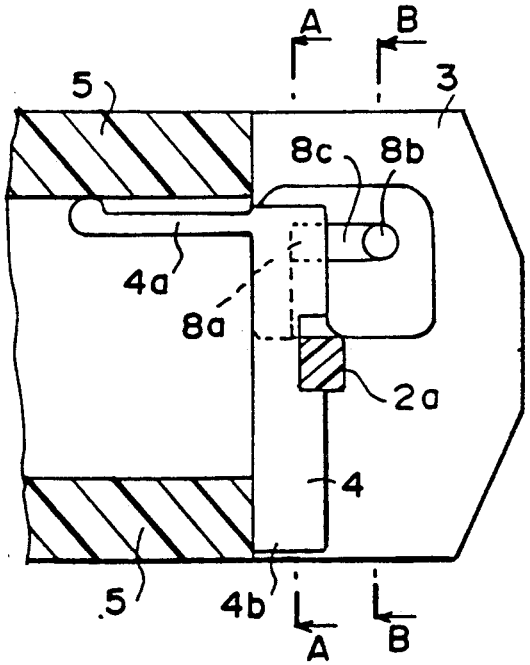
FIG. 4 is a fragmentary plan view showing the gas lighter with a safety device with the locking member in the releasing position.
Figure 5:
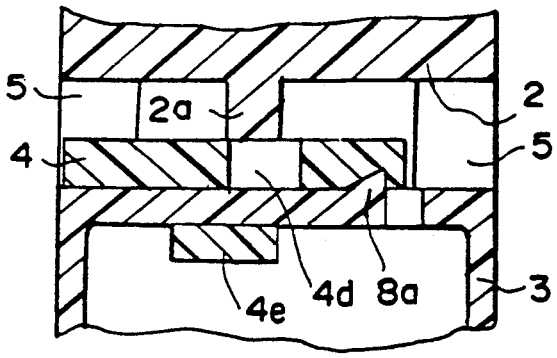
FIG. 5 is a fragmentary side cross-sectional view taken along line A—A in FIG. 4.
Figure 6:
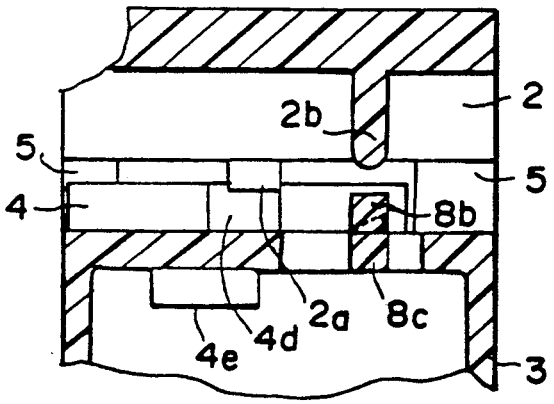
FIG. 6 is a fragmentary side cross-sectional view taken along line B—B in FIG. 4.
Figure 7:
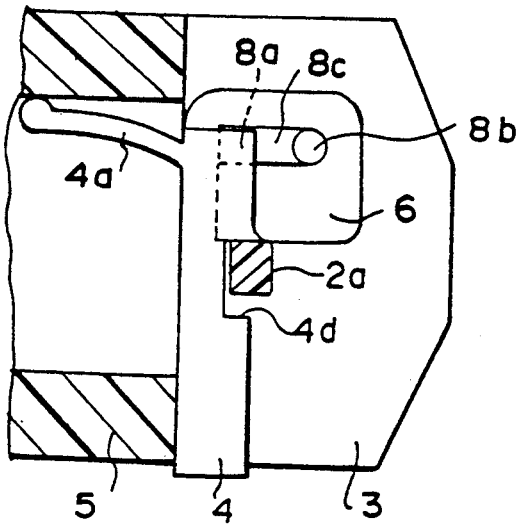
FIG. 7 is a fragmentary plan view with the lock member in the temporarily-held state.
Figure 8:
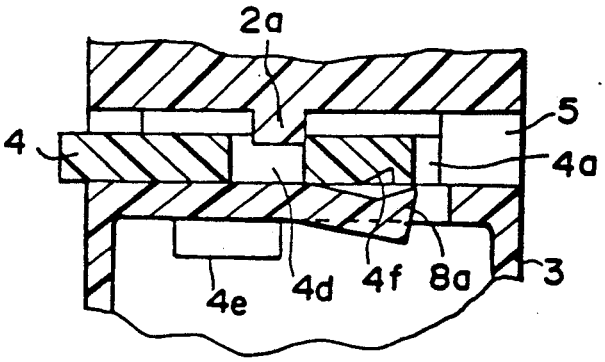
FIG. 8 is a fragmentary side cross-sectional view of the same.
Figure 9:
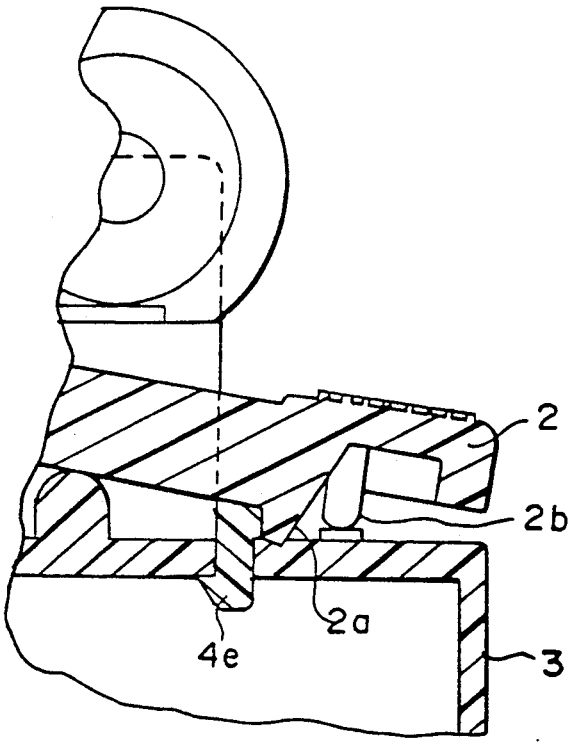
FIG. 9 is a fragmentary front cross-sectional view of the same.
Figure 10:
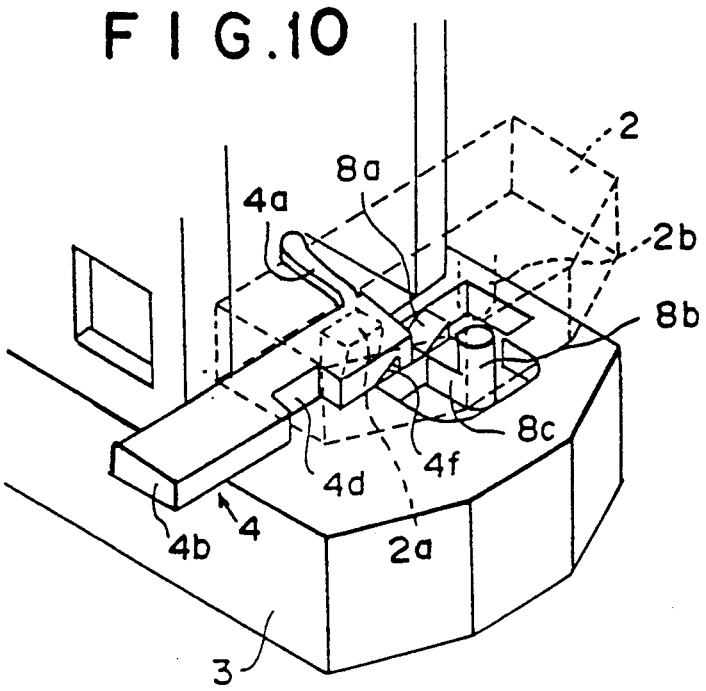
FIG. 10 is a perspective view showing the part shown in FIG. 6 with the lock member in the locking position.
Figure 11:
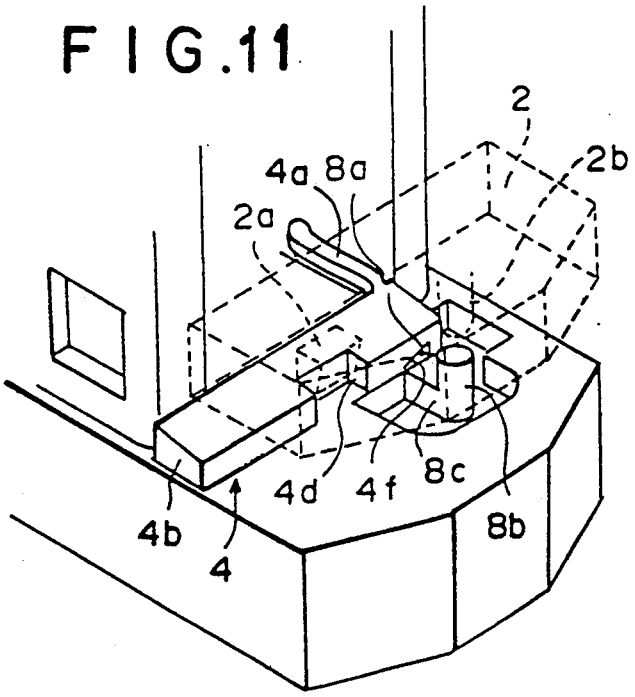
FIG. 11 is a perspective view showing the part shown in FIG. 6 with the lock member in the releasing position.
Figure 12:
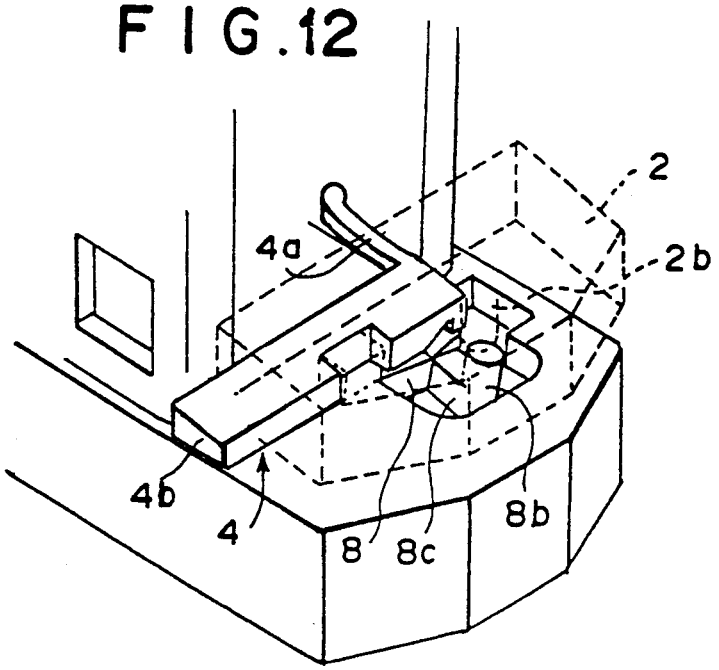
FIG. 12 is a perspective view showing the part shown in FIG. 6 with the lock member in a state just before the temporarily-held state after it is moved from the releasing position.
Figure 13:
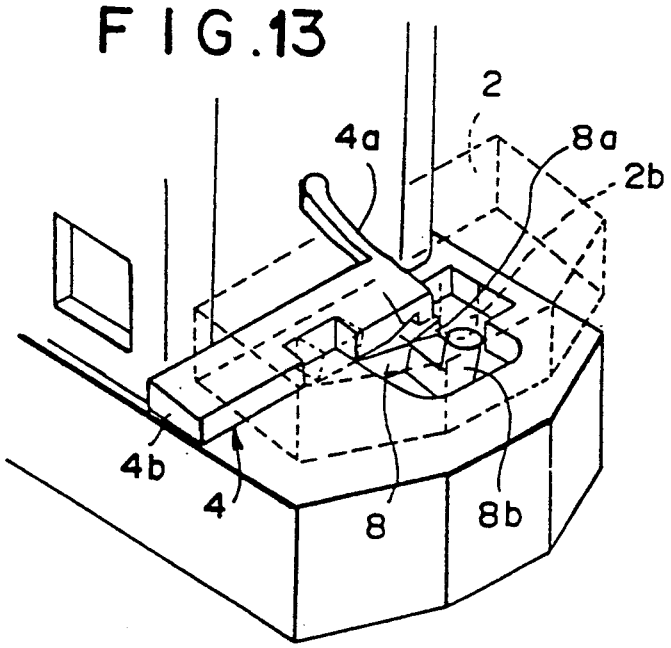
FIG. 13 is a perspective view showing the part shown in FIG. 6 with the lock member in the temporarily-held state.

When the lighter is used, the outer end 4*b* of the lock member 4 is pushed and the lock member 4 is moved to the releasing position shown in FIGS. 4 to 6, whereby depression of the valve lever 2 is permitted. When the lock member 4 is in the releasing position, the engagement recess 4*f* of the lock member 4 is engaged with the protrusion 8*a* of the holding member 8 and the lock member 4 is held in the releasing position. When the valve lever 2 is depressed in this state, the projection 2*a* of the valve lever 2 is received in the cutaway portion 4*d* of the lock member 4 and accordingly, the valve lever 2 can be moved downward, whereby release of fuel gas and actuation of the ignitor come to be possible.

In response to depression of the valve lever 2, the projection 2*b* on the lower surface of the ignition lever 2 pushes the projection 8*b* of the holding member 8, whereby the holding member 8 is deformed downward as shown in FIGS. 7 to 9 and 12 and 13 and the protrusion 8*a* is disengaged from the engagement recess 4*f* of the lock member 4. Accordingly, the lock member 4 tends to return to the locking position since it is spring-urged toward there. However, since the projection 2*a* of the valve lever 2 is still received in the cutaway portion 4*d* at this time and since the former is received in the latter with a slight play, the lock member 4 is moved from the releasing position toward the locking position by a small distance and is held there. That is, the lock member 4 is temporarily held in a position slightly deviated toward the locking position from the position where the protrusion 8*a* of the holding member 8 is disengaged from the engagement recess 4*f* of the lock member 4.

While the lock member 4 is in the temporarily held state, the lighter is ignited, and when the valve lever 2 is released after ignition, the valve lever 2 is moved upward and the projection 2*a* of the valve lever 2 is completely removed from the cutaway portion 4*d* of the lock member 4, whereby the lock member 4 is permitted to return to the locking position under the force of the spring and the whole mechanism is returned to the state shown in FIGS. 1 to 3 and 10.

As can be understood from the description above, the lock member 4 prevents depression of the valve lever 2 thereby preventing inadvertent ignition of the lighter while the lighter is not used, and the lock member 4 is automatically returned to the locking position after it is moved to the releasing position and the lighter is ignited. Thus the lock mechanism is automatically restored without operation after it is once released and the lighter is ignited, and accordingly, an extremely safe child resistant gas lighter can be realized.

Figure 1:
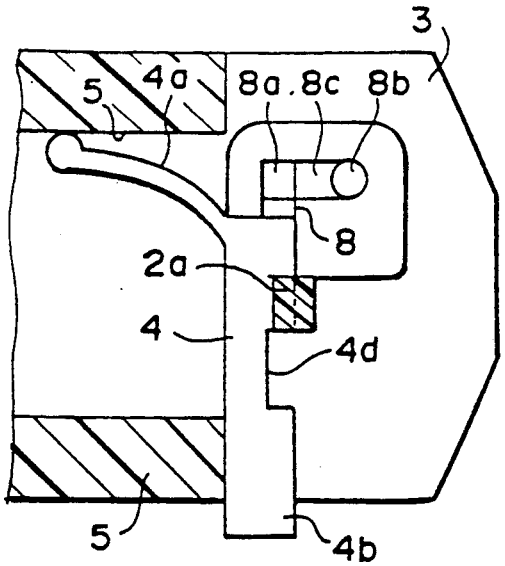
FIG. 1 is a fragmentary plan view showing a major part of a gas lighter with a safety device in accordance with an embodiment of the present invention with the locking member in the locking position.
Figure 2:
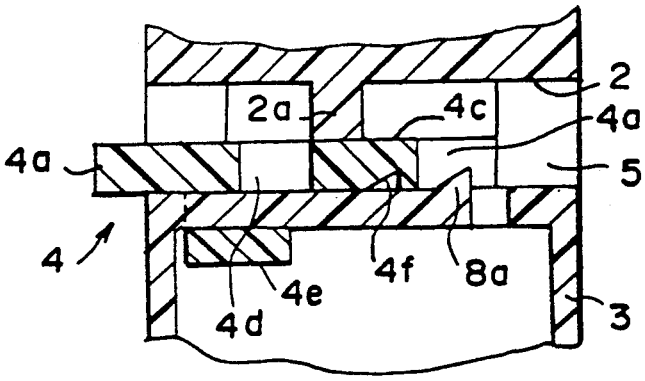
FIG. 2 is a fragmentary side cross-sectional view of the gas lighter with a safety device with the locking member in the locking position.
Figure 3:
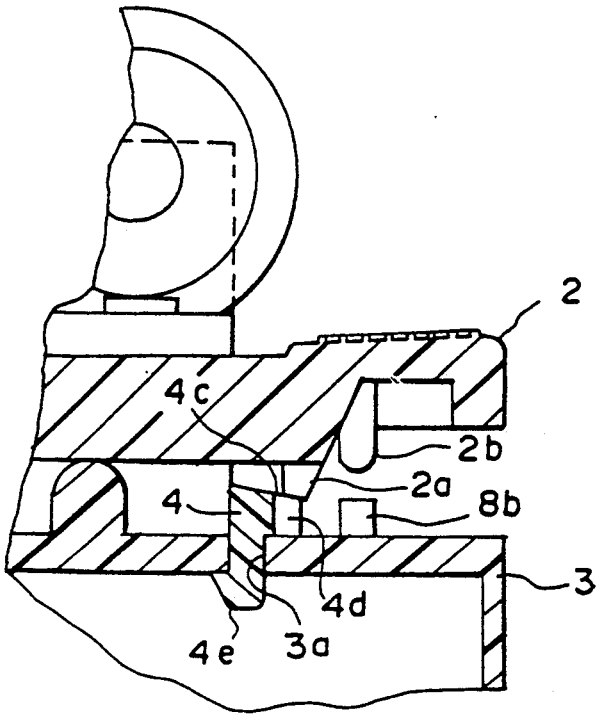
FIG. 3 is a fragmentary front cross-sectional view of the gas lighter with a safety device with the locking member in the locking position.

Though, in the embodiment described above, the lock member 4 is slidable sideways (in the vertical direction in FIG. 1) so that it is pushed in the transverse direction of the lighter body 3, it may be (left and right in FIG. 1).

Such an embodiment of the present invention will be described with reference to FIGS. 16 to 40, hereinbelow.

FIGS. 16 to 22, 33 and 37 show a gas lighter with a safety device in accordance with a second embodiment of the present invention when it is not used, i.e., when the lock member is in the locking position.

As shown in the figures, an valve lever 12 which releases fuel gas and actuates an ignitor by a conventional mechanism (not shown) when it is depressed is provided with a pair of projections 12*a* and 12*b* on the lower surface thereof. The projections 12*a* and 12*b* extend downward and are obliquely spaced from each other. A lock member 14 is provided below the valve lever 12 to be slidable in the direction in which the valve lever 12 extends between a locking position in which it prevents depression of the valve lever 12 and a releasing position in which it allows depression of the valve lever 12. A hook 14*e* which is fitted in a groove 13*b* formed on an intermediate casing 13*a*, which is provided on a lighter body 13, and retains the lockmember 14 on the intermediate casing 13*a* to be slidable thereon is formed on the lower surface of the lock member 14. The intermediate casing 13*a* is formed of resin material which has high resistance to heat and impact and is readily restorable after deformation.

The lock member 14 has a spring 15 which is compressed between a spring retaining surface 14*h* of the hook 14*e* and a vertical wall portion 13*c* of the intermediate casing 13*a* and is urged toward the locking position shown in FIGS. 16 to 19 by the spring 15. In the locking position, the projection 12*a* of the ignition lever 12 abuts against the upper surface 14*c* of the lock member 14 and prevents depression of the valve lever 12, and the outer end 14*g* of the lock member 14 projects outside the lighter body 13.

When the outer end 14*g* of the lock member 14 is pushed overcoming the force of the spring 15, the lock member 14 moves from the locking position to the releasing position (FIGS. 23 to 25, 34 and 38), where a cutaway portion 14*d* formed in a side wall of the lock member 14 is aligned with the projection 12*a* of the valve lever to receive it when the valve lever 12 is depressed thereby permitting depression of the valve lever 12.

Figure 16:
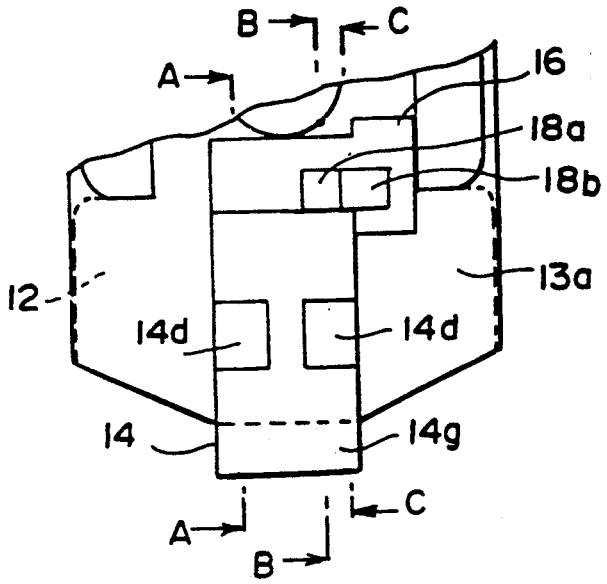
FIG. 16 is a fragmentary plan view showing a major part of a gas lighter with a safety device in accordance with still another embodiment of the present invention with the lock member in the locking position.
Figure 17:
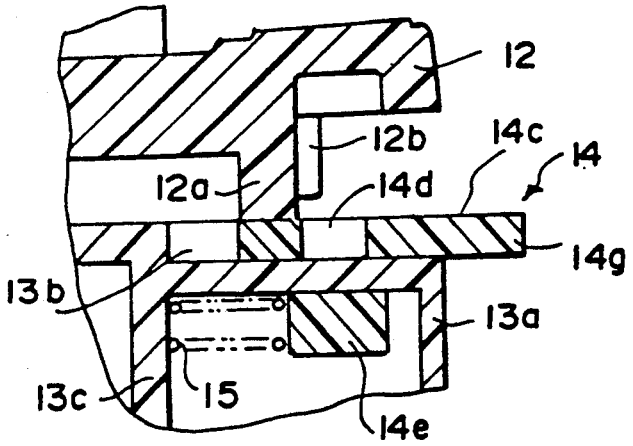
FIG. 17 is a cross-sectional view taken along line A—A in FIG. 16.
Figure 18:
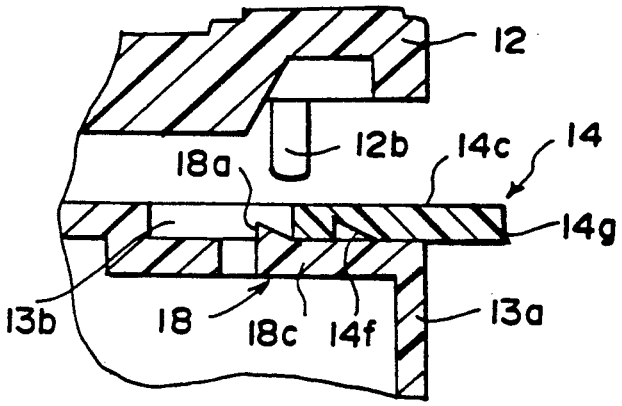
FIG. 18 is a cross-sectional view taken along line B—B in FIG. 16.
Figure 19:
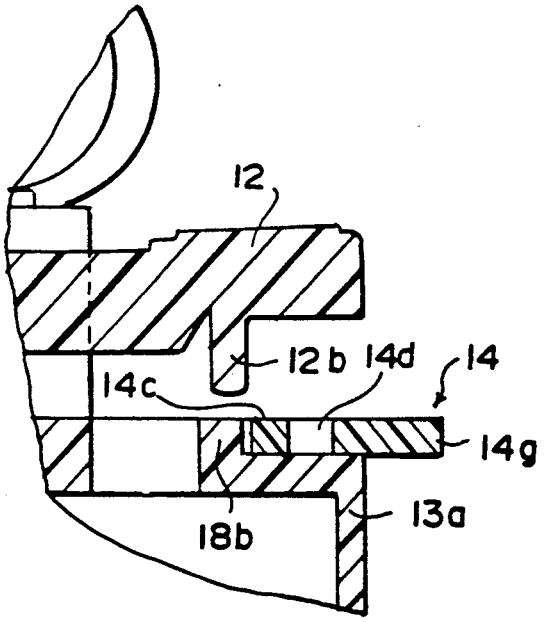
FIG. 19 is a cross-sectional view taken along line C—C in FIG. 16.
Figure 20:
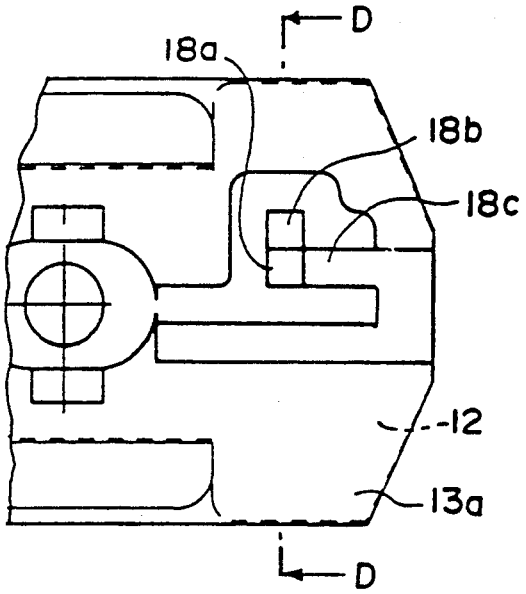
FIG. 20 is a fragmentary plan view of the upper part of the lighter with the lock member removed.
Figure 21:
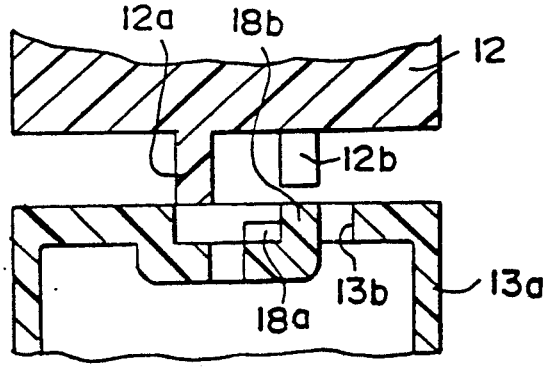
FIG. 21 is a fragmentary cross-sectional view taken along line D—D in FIG. 20.
Figure 22:
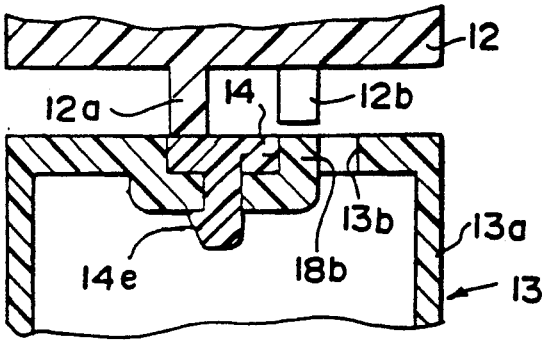
FIG. 22 is a fragmentary cross-sectional view of the upper part of the lighter with the lock member in the locking position.

An engagement recess 14*f* for holding the lock member 14 in the releasing position when it is moved there is formed on the lower surface of the lock member 14. The intermediate casing 13*a* is provided with a holding member 18 which is formed on a wall portion of a rectangular recess 16 formed on the upper part of the intermediate casing 13*a* (FIG. 16). The holding member 18 has a cantilever-like arm 18*c* which is formed integrally with the intermediate casing 13*a* to be resiliently deformed. As clearly shown in FIGS. 16 and 20, a rightangled extension is formed on the tip of the holding member 18 and a protrusion 18*a* adapted to be engaged with the engagement recess 14*f* is formed at the corner. Further a projection 18*b* is formed on the tip of the extension. The projection 18*b* is positioned just below the projection 12*b* of the ignition lever 12 and is pushed downward when the valve lever 12 is depressed, whereby the holding member 18 is resiliently deformed downward and the protrusion 18*a* is disengaged from the engagement recess 14*f* of the lock member 14.

The valve lever 12 is provided with an engagement portion which engages with the lock member 14 released from the holding member 18 and temporarily holds the lock member 14 in the releasing position until the ignition lever 12 moves upward from the depressed position to the position before depression. The projection 12*a* functions as the engagement portion. Though the engagement portion may be formed separately from the projection 12*a*, it is preferred that the projection 12*a* be used also as the engagement portion in view of simplification of the structure.

The operation of the gas lighter in accordance with this embodiment will be described in detail, hereinbelow.

Figure 33:
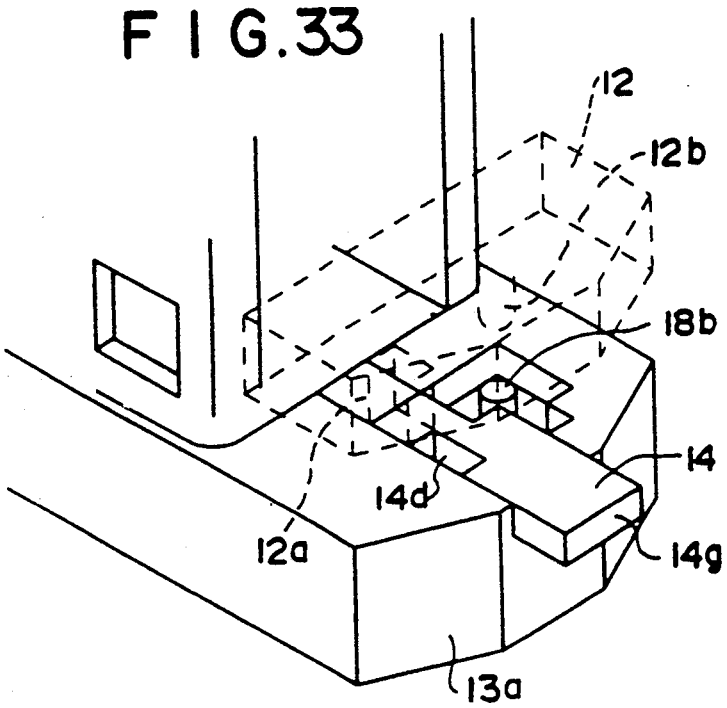
FIG. 33 is a perspective view as viewed from a left front side with the valve lever in the locked state.
Figure 37:
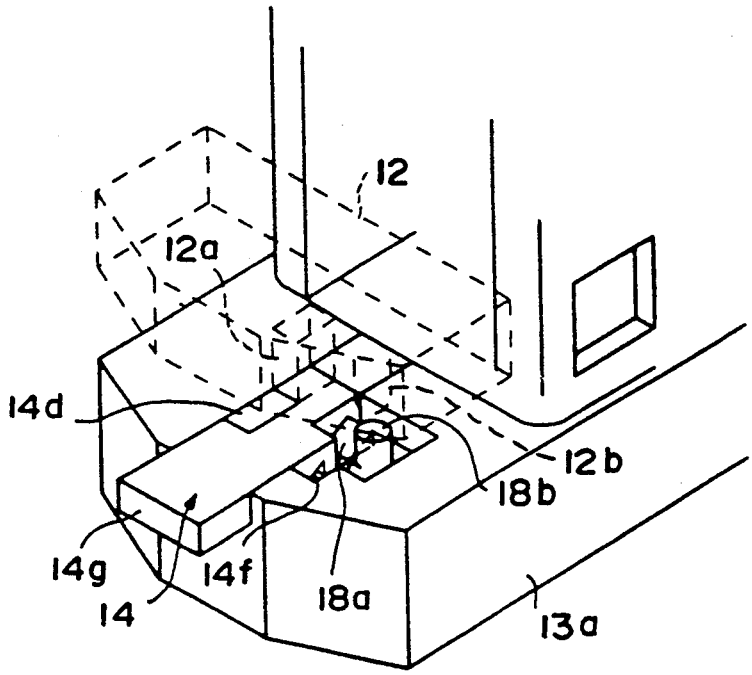
FIG. 37 is a perspective view as viewed from a right front side with the valve lever in the locked state.

When the lighter is not used, the lock member 14 is in the locking position shown in FIGS. 16, 33 and 37 as described above and the valve lever 12 cannot be depressed. Accordingly, in this state, the lighter cannot be ignited and inadvertent ignition by children or the like is prevented.

Figure 23:
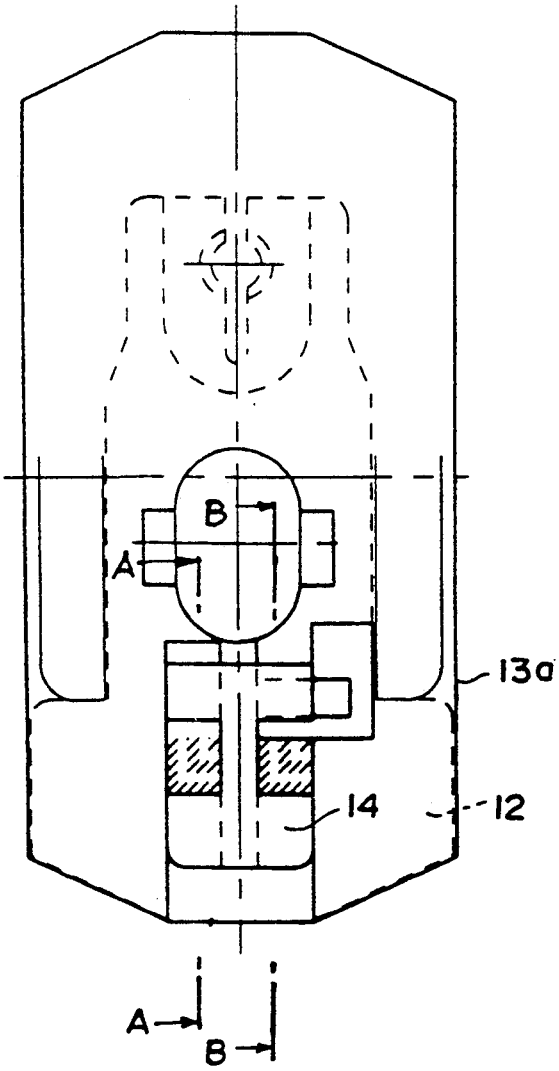
FIG. 23 is a view similar to FIG. 22 but with the lock member in the releasing position.
Figure 24:
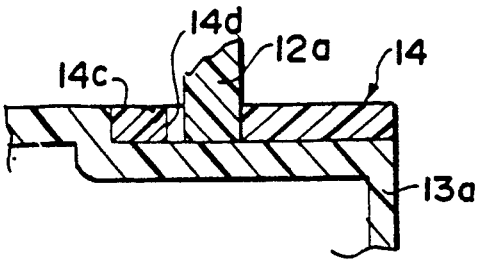
FIG. 24 is a cross-sectional view taken along line A—A in FIG. 16 with the lock member in the releasing position.
Figure 25:
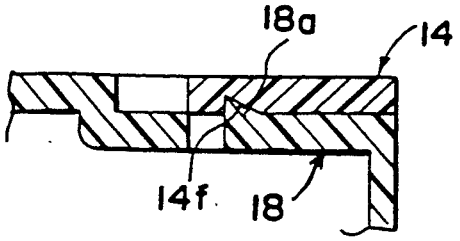
FIG. 25 is a cross-sectional view taken along line B—B in FIG. 16 with the lock member in the releasing position.
Figure 26:
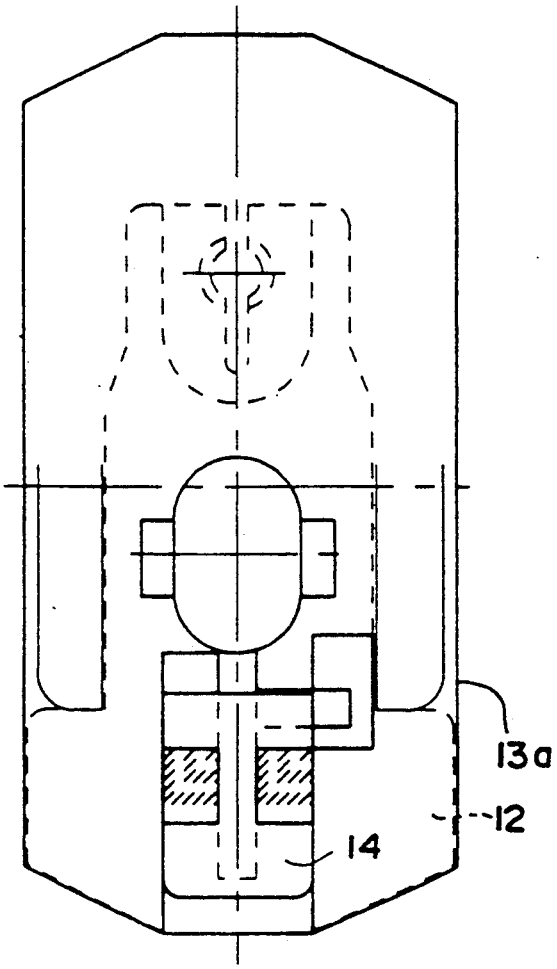
FIG. 26 is a plan view of the lighter with the lock member in the temporarily-held state.
Figure 27:
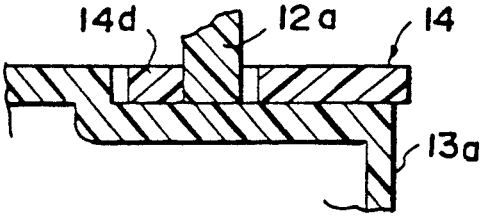
FIG. 27 is a cross-sectional view taken along line A—A in FIG. 16 with the lock member in the temporarily-held state.
Figure 34:
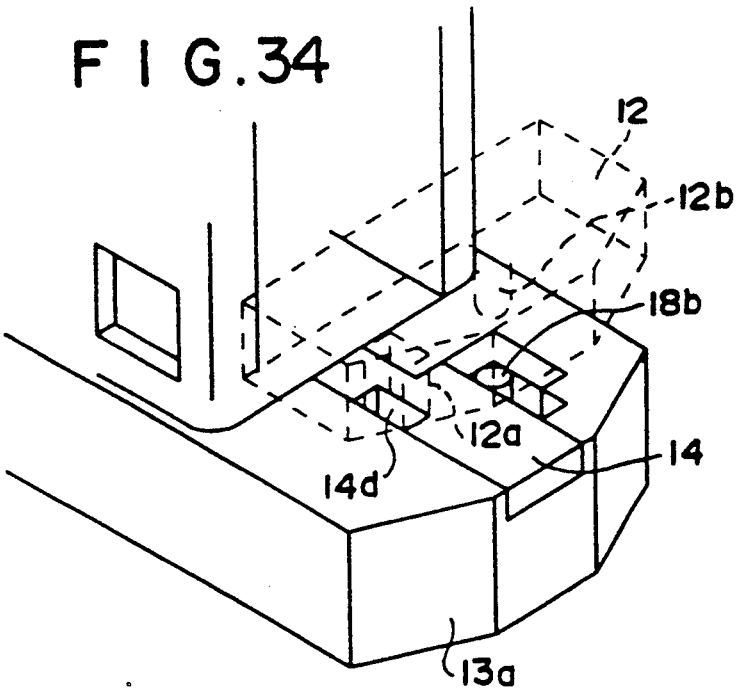
FIG. 34 is a view similar to FIG. 33 but with the valve lever in the released state.
Figure 35:
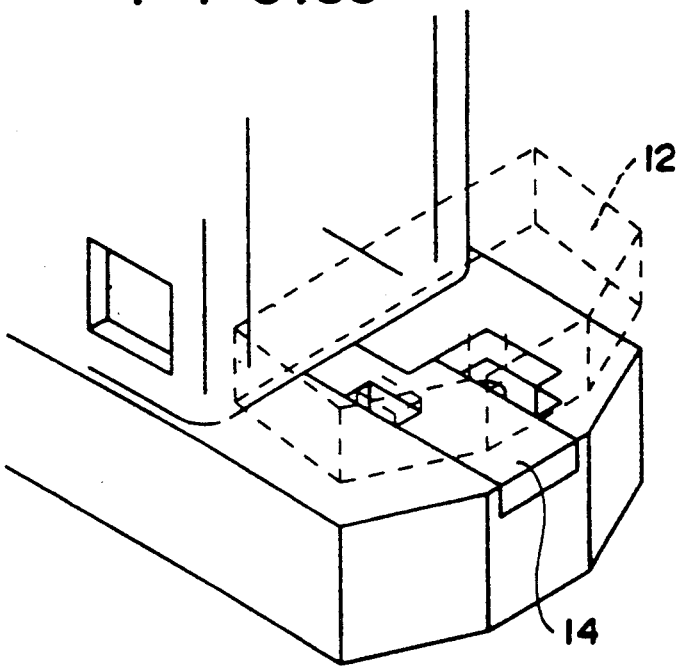
FIG. 35 is a view similar to FIG. 33 but with the lock member in a state just before the temporarily-held state after it is moved from the releasing position.
Figure 36:
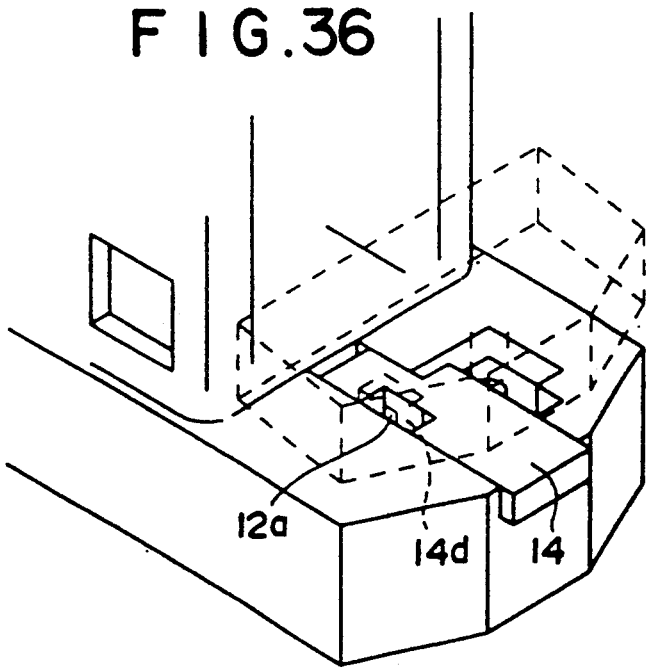
FIG. 36 is a view similar to FIG. 33 but with the lock member in the temporarily-held state.
Figure 38:
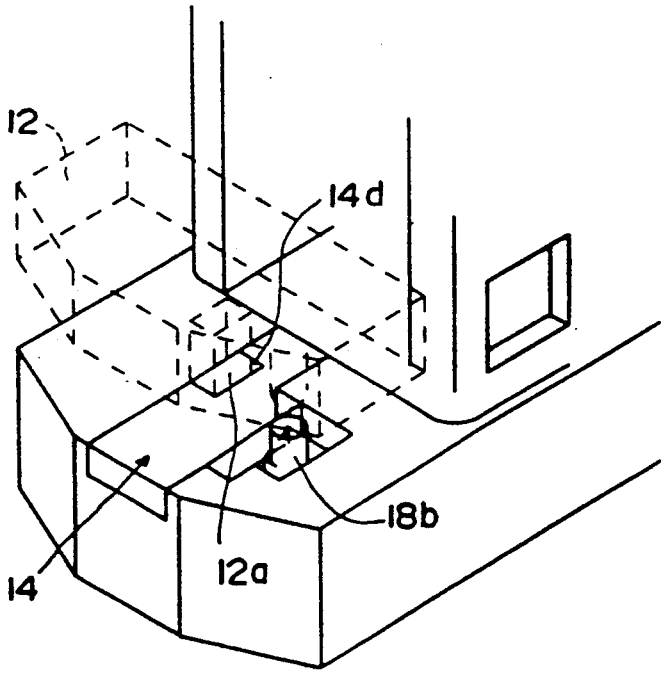
FIG. 38 is a view similar to FIG. 37 but with the valve lever in the released state.
Figure 39:
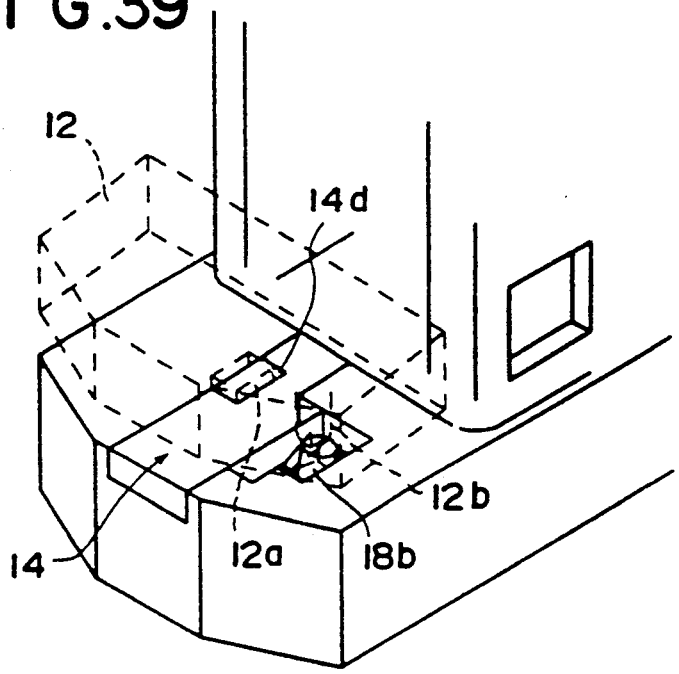
FIG. 39 is a view similar to FIG. 37 but with the lock member in a state just before the temporarily-held state after it is moved from the releasing position.
Figure 40:
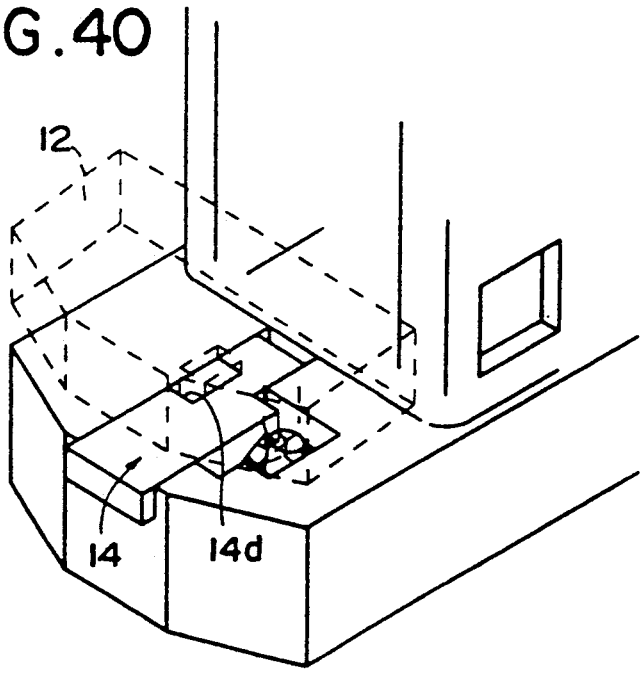
FIG. 40 is a view similar to FIG. 37 but with the lock member in the temporarily-held state.

When the lighter is used, the outer end 14*g* of the lock member 14 is pushed and the lock member 14 is moved to the releasing position shown in FIGS. 23, 34 and 38, whereby depression of the valve lever 12 is permitted. When the lock member 14 is in the releasing position, the engagement recess 14*f* of the lock member 14 is engaged with the protrusion 18*a* of the holding member 18 and the lock member 14 is held in the releasing position. (See FIG. 25) When the valve lever 12 is depressed in this state, the projection 12*a* of the valve lever 12 is received in the cutaway portion 14*d* of the lock member 14 and accordingly, the valve lever 12 can be moved downward (FIG. 24), whereby release of fuel gas and actuation of the ignitor come to be possible.

Figure 28:
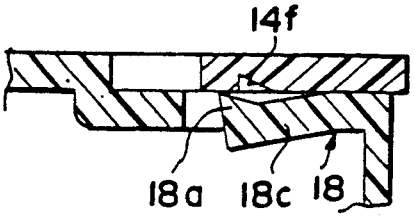
FIG. 28 is a cross-sectional view taken along line B—B in FIG. 16 with the lock member in the temporarily-held state.
Figure 29:
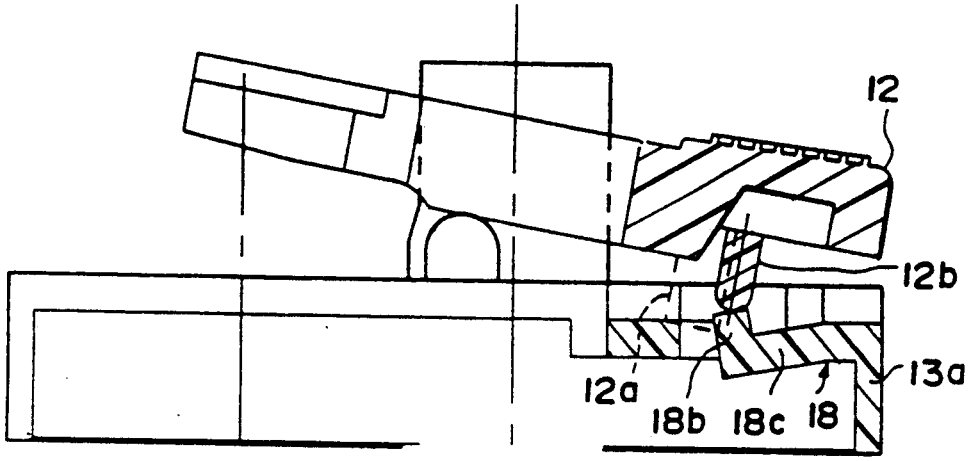
FIG. 29 is a cross-sectional view taken along line C—C in FIG. 16 with the lock member in the temporarily-held state.
Figure 30:
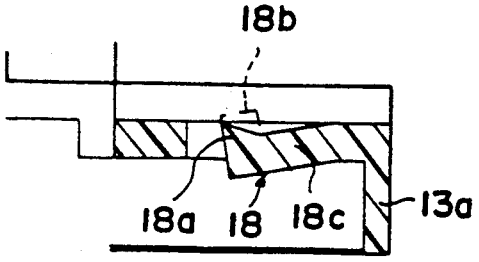
FIG. 30 is a view showing the positions of the projection on the lower end of the ignition lever and the projection of the holding member relative to each other in the cross-section along the line B—B in FIG. 16.

In response to depression of the valve lever 12, the projection 12*b* on the lower surface of the ignition lever 12 pushes the projection 18*b* of the holding member 18, whereby the holding member 18 is deformed downward as shown in FIG. 28 and the protrusion 18*a* is disengaged from the engagement recess 14*f* of the lock member 14. Accordingly, the lock member 14 tends to return to the locking position under the force of the spring 15. However, since the projection 12*a* of the valve lever 12 is still received in the cutaway portion 14*d* at this time and since the former is received in the latter with a slight play, the lock member 14 is moved from the releasing position toward the locking position by a small distance and is held there. (FIGS. 27, 36 and 40) That is, the lock member 14 is temporarily held in a position slightly deviated toward the locking position from the position where the protrusion 18*a* of the holding member 18 is disengaged from the engagement recess 14*f* of the lock member 14.

While the lock member 14 is in the temporarily held state, the lighter is ignited, and when the valve lever 12 is released after ignition, the valve lever 12 is moved upward and the projection 12*a* of the valve lever 12 is completely removed from the cutaway portion 14*d* of the lock member 14, whereby the lock member 14 is permitted to return to the locking position under the force of the spring 15 and the whole mechanism is returned to the state shown in FIGS. 16, 33 and 37.

As can be understood from the description above, also in this embodiment, the lock member 14 prevents depression of the valve lever 12 thereby preventing inadvertent ignition of the lighter while the lighter is not used, and the lock member 14 is automatically returned to the locking position after it is moved to the releasing position and the lighter is ignited. Thus the lock mechanism is automatically restored without operation after it is once released and the lighter is ignited, and accordingly, an extremely safe child resistant gas lighter can be realized.

Figure 42:
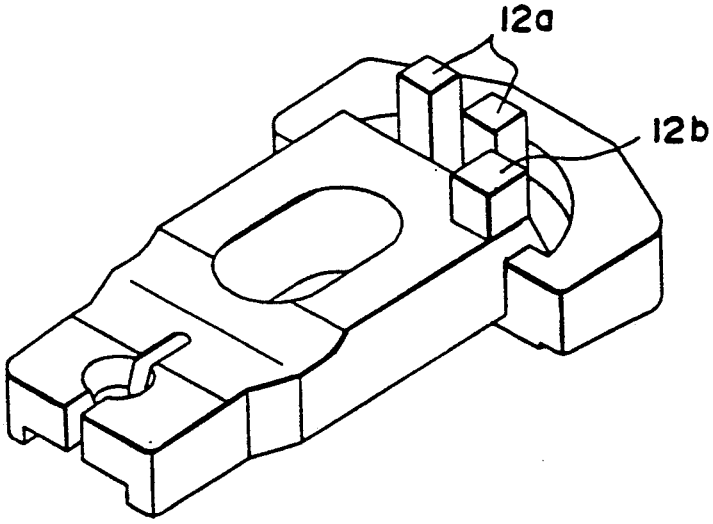
FIG. 42 is a perspective view showing the back side of the valve lever as viewed in one direction.
Figure 43:
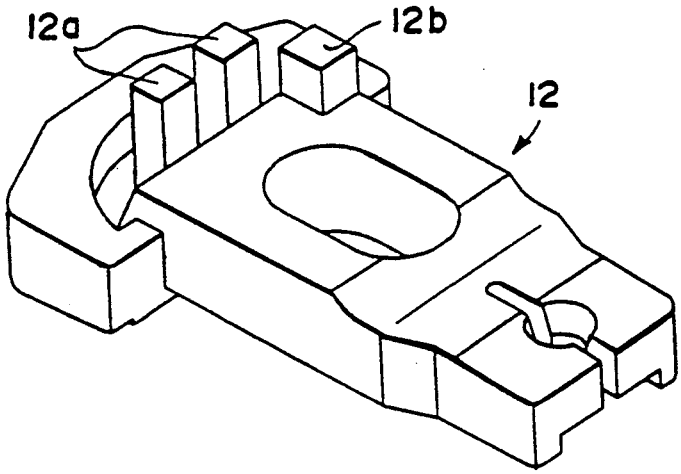
FIG. 43 is a perspective view showing the back side of the valve lever as viewed in another direction.
Figure 44:
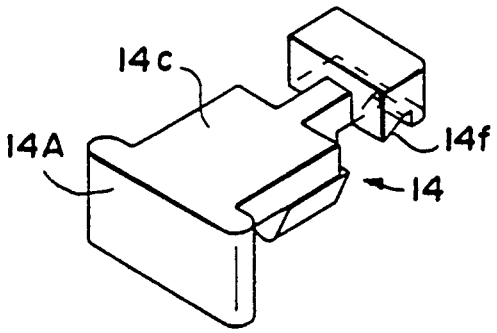
FIG. 44 is a perspective view showing the lock member employed in the embodiment.
Figure 45:
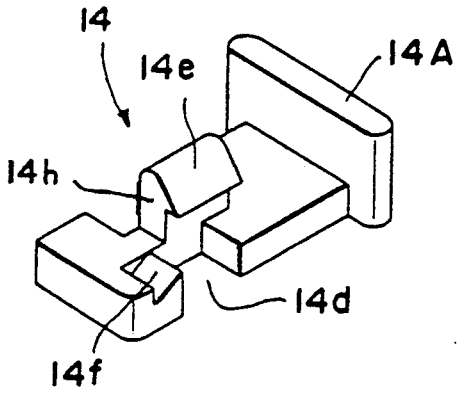
FIG. 45 is a perspective view showing the back side of the lock member as viewed in one direction.
Figure 46:
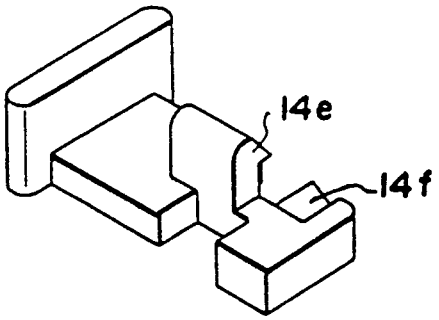
FIG. 46 is a perspective view showing the back side of the lock member as viewed in another direction.

Though the shapes and structures of the respective members employed in this embodiment are apparent from FIGS. 16 to 40, they are shown in more detail and more clearly in FIGS. 41 to 48. The members shown in FIGS. 41 to 48 are substantially the same as those shown in FIGS. 16 to 40 in arrangement, and accordingly are given the same reference numerals. However, the former are different from the latter in detail. For example, the lock member 14 shown in FIGS. 44 to 46 are provided with an end plate 14A which facilitates pushing the lock member 14 with a finger.

Figure 41:
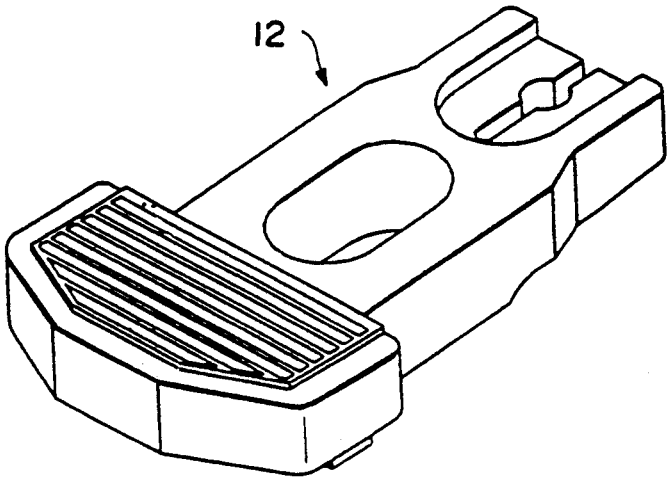
FIG. 41 is a perspective view showing the ignition lever employed in a lighter in accordance with still another embodiment of the present invention which is substantially the same in arrangement as the embodiment shown in FIGS. 16 to 40.
Figure 47:
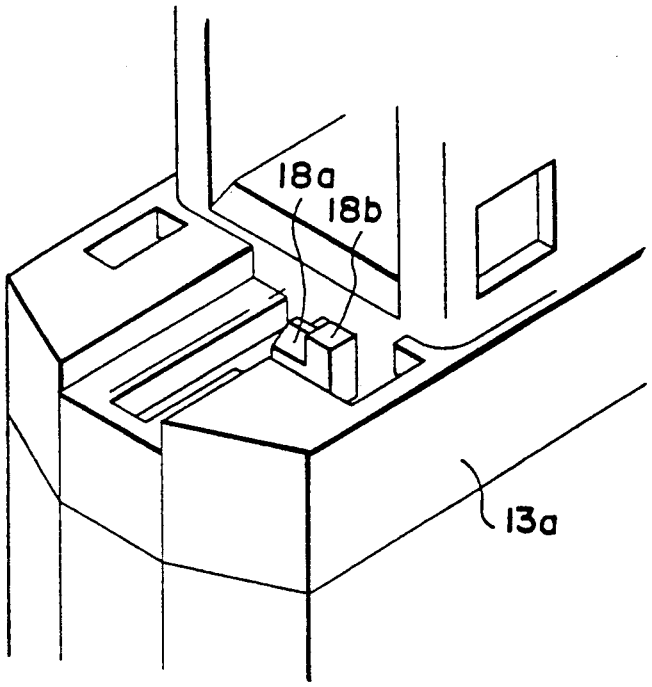
FIG. 47 is a perspective view as viewed in one direction showing the intermediate casing employed in the embodiment.
Figure 48:
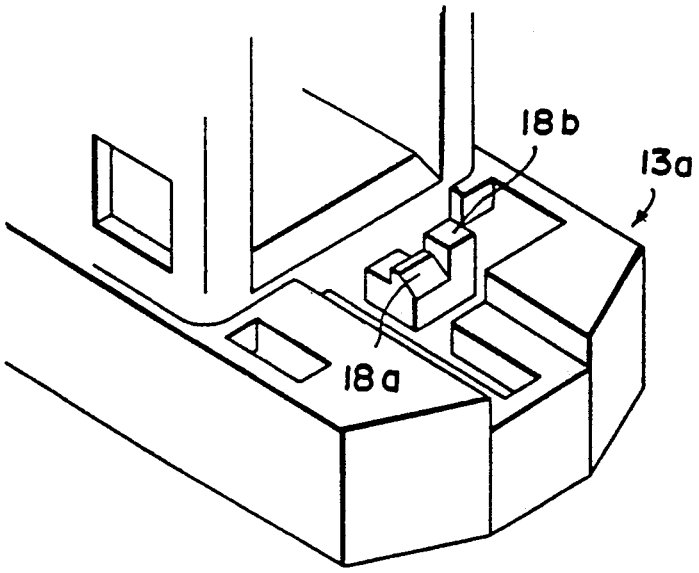
FIG. 48 is a perspective view as viewed in another direction showing the intermediate casing.

FIG. 41 is a perspective view showing the valve lever 12, FIG. 42 is a perspective view showing the back side of the valve lever as viewed in one direction, FIG. 43 is a perspective view showing the back side of the valve lever as viewed in another direction, FIG. 44 is a perspective view showing the lock member 14 employed in the embodiment, FIG. 45 is a perspective view showing the back side of the lock member 14 as viewed in one direction, FIG. 46 is a perspective view showing the back side of the lock member 14 as viewed in another direction, FIG. 47 is a perspective view as viewed in one direction showing the intermediate casing 13*a* provided on the lighter body 13 employed in the embodiment, and FIG. 48 is a perspective view as viewed in another direction showing the intermediate casing 13*a*. In this embodiment, the means for urging the lock member 14 to the locking position is the spring 15 which is compressed between a side surface of the hook 14*e* of the lock member 14 and the intermediate casing 13*a*.

When the lock member is arranged to be foldable in the locking position, the lock member can be surely held in the locking position and at the same time ease of handling the lighter can be improved. Such an embodiment will be described with reference to FIGS. 49 to 58, hereinbelow.

In this embodiment, the lock member 14 is slidable in the longitudinal direction as in the embodiment shown in FIGS. 16 to 40, and the arrangement and the operation of each part is substantially the same and accordingly will not be described here. The parts shown in FIGS. 49 to 58 are given reference numerals obtained by adding 10 to the reference numerals which are given to the corresponding parts in FIGS. 16 to 58.

Figure 49:
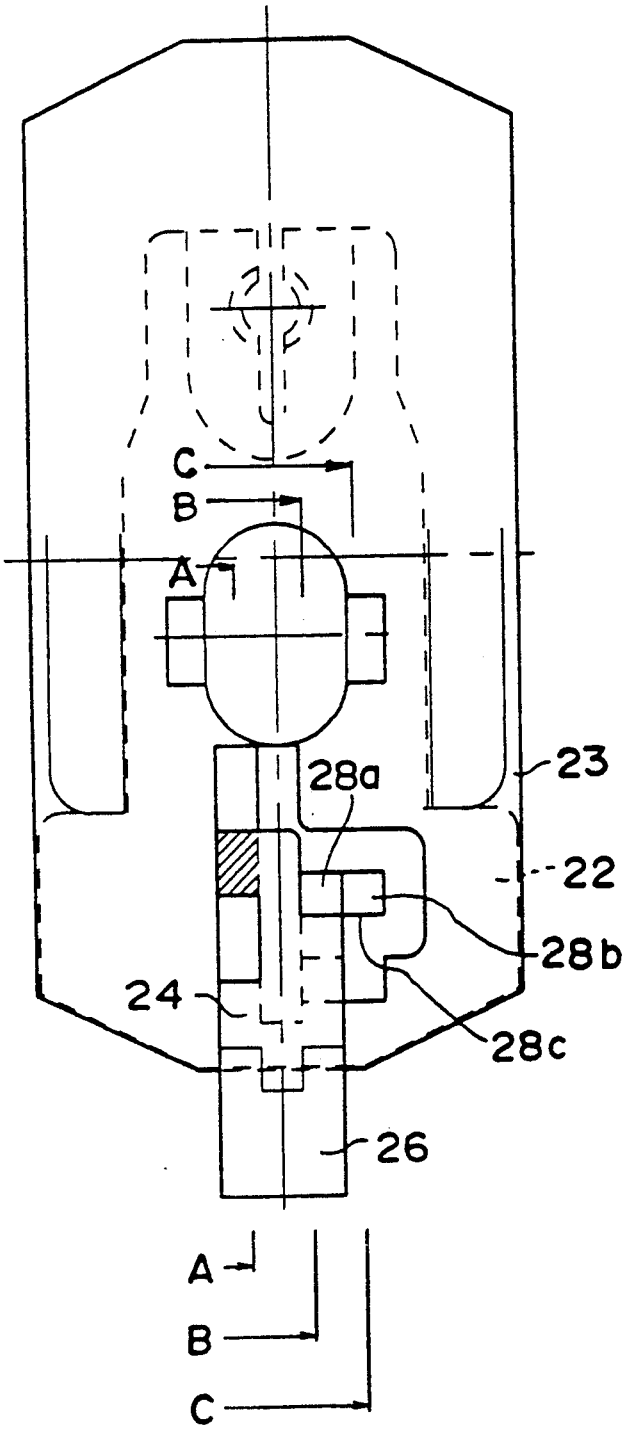
FIG. 49 is a fragmentary plan view showing a major part of a gas lighter with a safety device in accordance with still another embodiment of the present invention with the lock member in the locking position.
Figure 50:
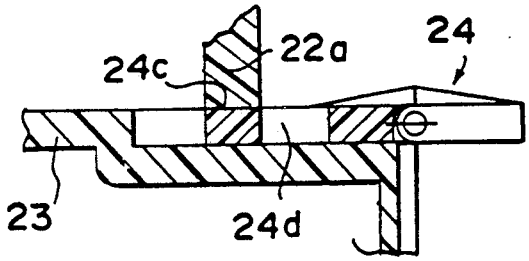
FIG. 50 is a cross-sectional view taken along line A—A in FIG. 49.
Figure 52:
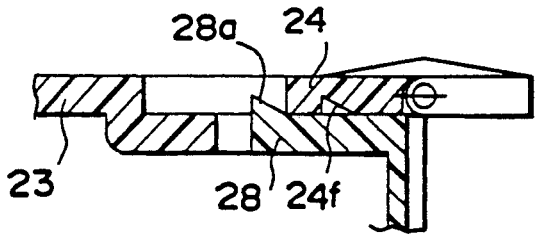
FIG. 52 is a cross-sectional view taken along line B—B in FIG. 49.

FIG. 50 is a cross-sectional view taken along line A—A in FIG. 49, and FIG. 52 is a cross-sectional view taken along line B—B in FIG. 49. The lock member 24 has an outer end portion 26 which projects outside the lighter body 23, and the lock member 24 is moved to the releasing position from the locking position when the outer end portion 26 is pushed into the lighter body 23. The outer end portion 26 of the lock member 24 is foldable about a pivot 25, and when the lighter is not used, the outer end portion 26 is folded, whereby the lock member 24 can be surely held in the locking position and at the same time ease of handling the lighter can be improved.

Figure 53:
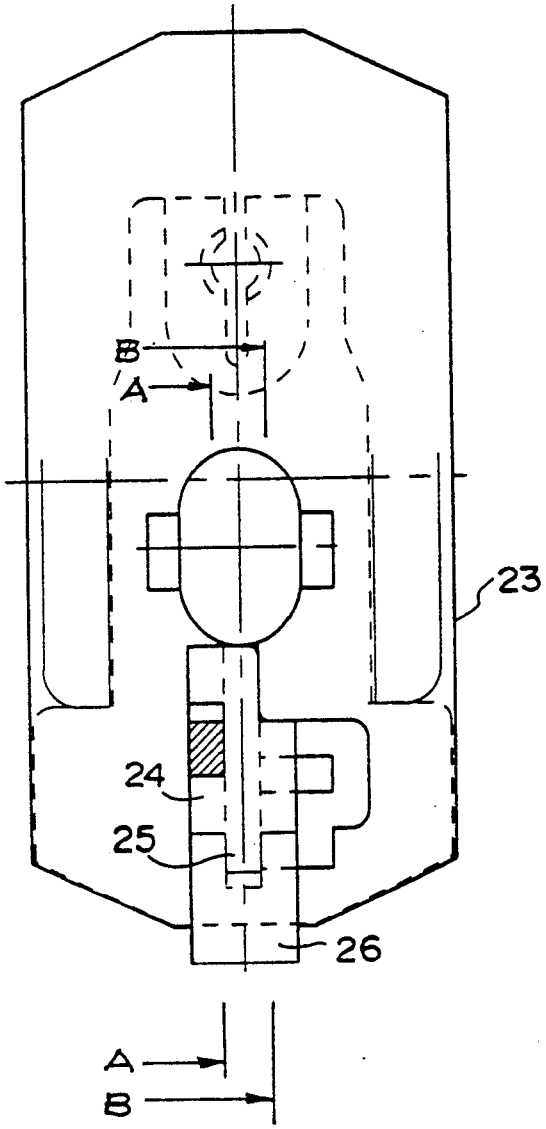
FIG. 53 is a view similar to FIG. 49 but with the lock member in the releasing position.
Figure 54:
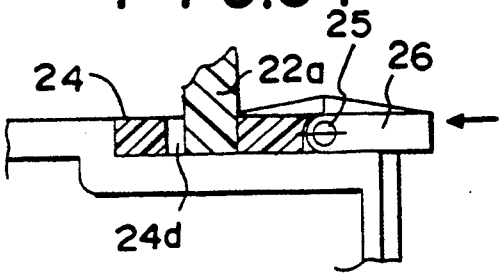
FIG. 54 is a cross-sectional view taken along line A—A in FIG. 53 but with the lock member in the releasing position.
Figure 55:
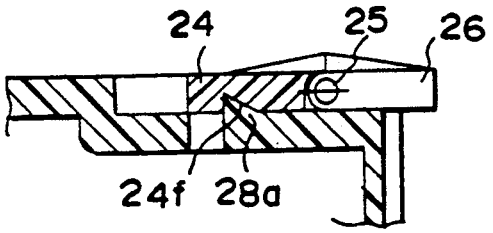
FIG. 55 is a cross-sectional view taken along line B—B in FIG. 53 but with the lock member in the releasing position.

When the lighter is used, the outer end portion 26 is first unfolded as shown in FIG. 52 and then the lock member 24 is moved from the locking position shown in FIG. 52 to the releasing position shown in FIGS. 53 to 55 so that the depression of the ignition lever 22 is permitted.

Figure 51:
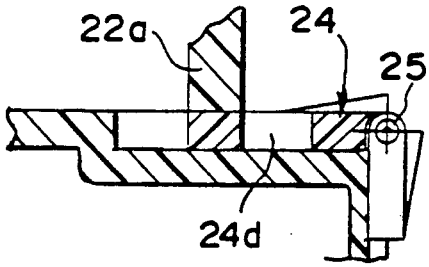
FIG. 51 is a view similar to FIG. 50 but with the lock member folded.

In this embodiment, since the outer end portion 26 of the lock member 24 is foldable about the pivot 25 and is folded as shown in FIG. 51 when the lighter is not used and is unfolded only when the lighter is used, handling of the lighter is facilitated and the lock member 24 can be steadily held in the locking position.

Figure 56:
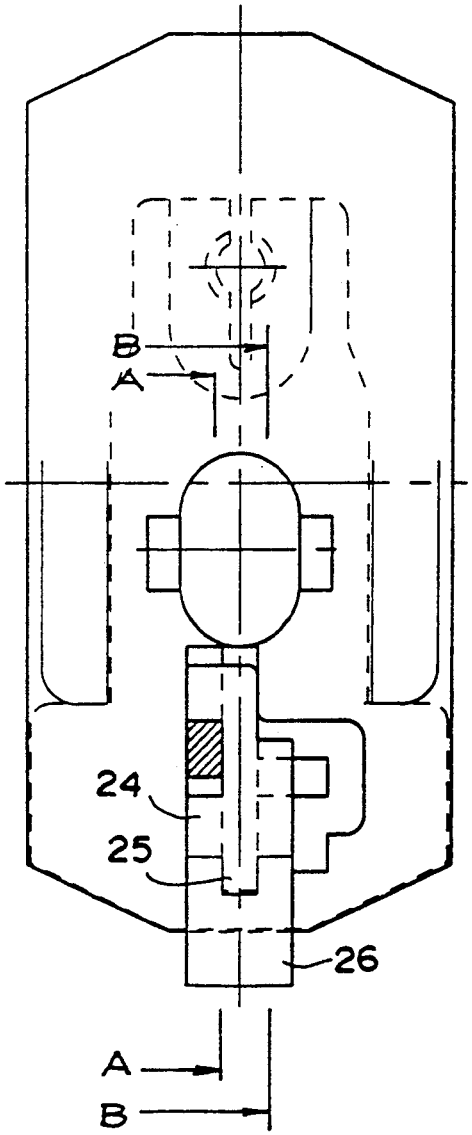
FIG. 56 is a view similar to FIG. 49 but with the lock member in the temporarily-held state.
Figure 57:
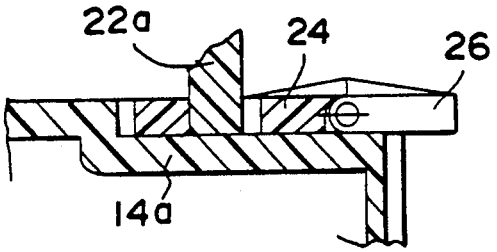
FIG. 57 is a cross-sectional view taken along line A—A in FIG. 56 but with the lock member in the temporarily-held state.
Figure 58:
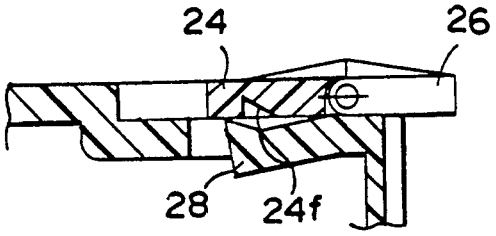
FIG. 58 is a cross-sectional view taken along B—B in FIG. 56 but with the lock member in the temporarily-held state.

FIG. 56 is a plan view of the lighter with the lock member 24 in the temporarily-held state, FIG. 57 is a cross-sectional view taken along A—A in FIG. 56 showing the lock member 24 in the temporarily-held state, and FIG. 58 is a cross-sectional view taken along line B—B in FIG. 56 showing the lock member 24 in the temporarily-held state. The FIGS. 56 to 58 respectively correspond to FIGS. 26 to 28 in the second embodiment.

Though this embodiment in which the outer end portion 26 of the lock member 24 is foldable is applied to the embodiment shown in FIGS. 16 to 40 in which the lock member 24 is slidable in the longitudinal direction, it may be applied to the embodiment shown in FIGS. 1 to 15 in which the lock member 24 is slidable in the transverse direction.

The embodiments described above are, needless to say, just examples and they may be modified in various ways.

Figure 59:
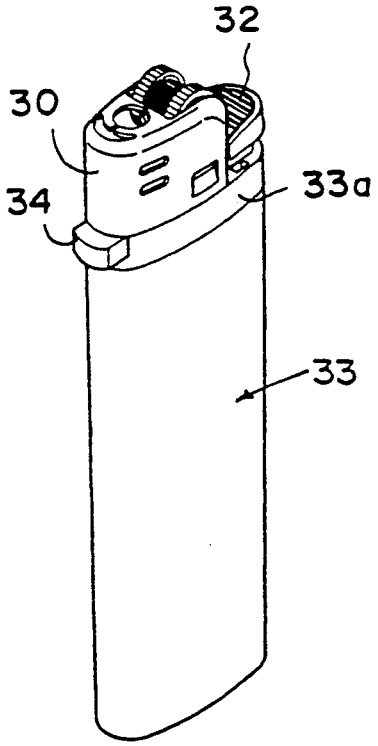
FIG. 59 is a perspective view showing a gas lighter with a safety device in accordance with still another embodiment of the present invention in which the lock member is provided in a different position.

For example, in the embodiments described above, either of the lock members 14 and 24 is pushed into the lighter body 13 or 23 from the ignition lever side, the lock member may be arranged to be pushed into the lighter body from the opposite side i.e., from the wind shield side. Such an embodiment is shown in FIG. 59. In the embodiment shown in FIG. 59, the lock member 34 is pushed into the lighter body 33 along the upper surface of the intermediate casing 33*a* from the side near the wind shield 30.

Figure 60:
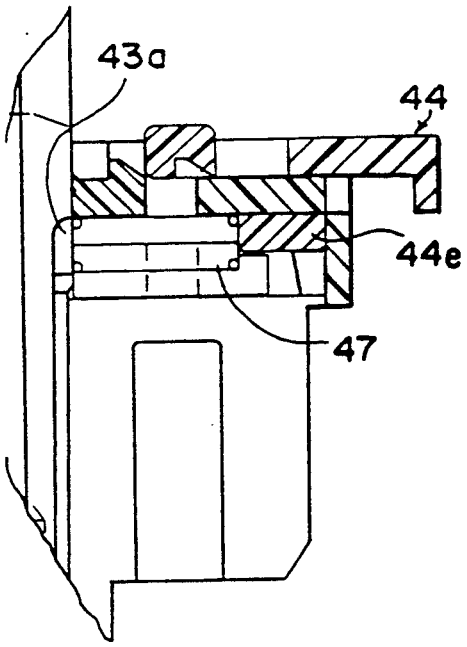
FIG. 60 is a cross-sectional view for illustrating a gas lighter with a safety device in accordance with still another embodiment of the present invention.
Figure 61:
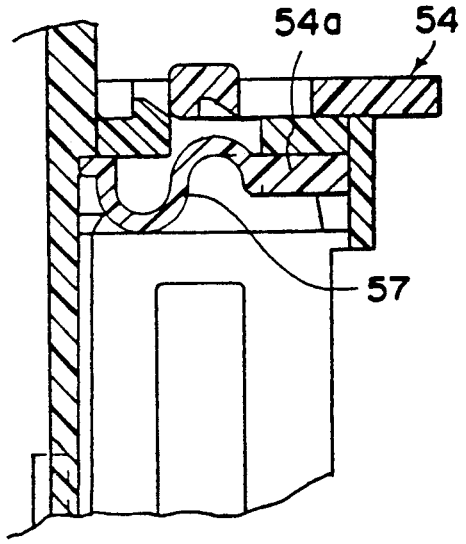
FIG. 61 is a cross-sectional view for illustrating a gas lighter with a safety device in accordance with still another embodiment of the present invention in which the spring for the lock member is formed integrally with the lock member.

Further as the means for urging the lock member to the locking position, a coil spring 47 retained between the hook 44*e* of the lock member 44 and a part of the intermediate casing 43*a* as shown in FIG. 60, or a spring 57 formed integrally with a part 54*a* of the lock member 54 as shown in FIG. 61 may be used. The material for forming such resilient members need not be limited to iron. For example, they may be made of plastic material.

Further, though there has been described the spring 7 shown in FIGS. 14 and 15 in addition to the arm 4*a* as the means for urging the lock member 4 in the first embodiment, the lock member 4 may be urged to the locking position by other means. For example, a push button may be fixed to the lock member 4 and may be formed of a resilient material or provided with a coil spring so that the lock member 4 is urged to the locking position under the resiliency of the push button itself or the coil spring.

Further, though, in the embodiment described above, the holding member 18 or 28 extends inward to be resiliently deformable with its one end supported on a side of the lighter body 23 or the intermediate casing 13*a*, the holding member may extend outward to be resiliently deformable with its one end supported inside the lighter body 23 or the intermediate casing 13*a*. Such an embodiment is shown in FIGS. 62 to 66.

Figure 62:
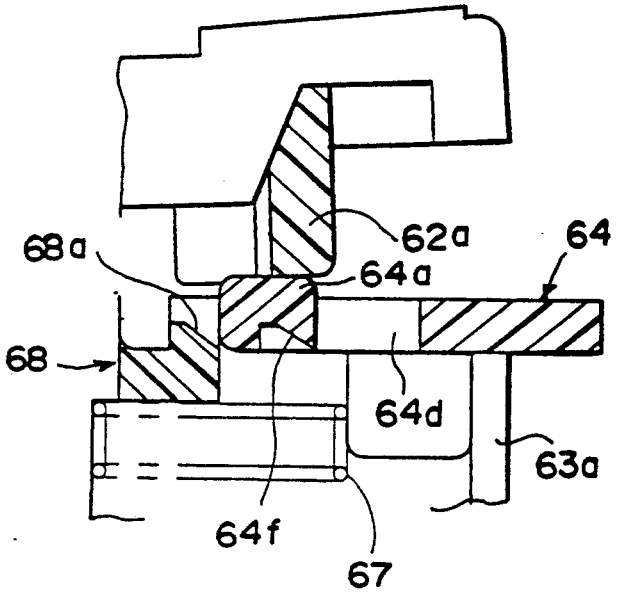
FIG. 62 is a cross-sectional view for illustrating a gas lighter with a safety device in accordance with still another embodiment of the present invention in which the holding member is supported in the lighter body in a cantilever fashion to extend outward so as to be resiliently deformable, the lock member being in the locking position.

This embodiment is substantially the same as the embodiment shown in FIGS. 16 to 40 in the basic arrangement and the operation. That is, when the lighter is not used, the lock member 64 is in the locking position as shown in FIG. 62 where it projects outside and the projection 62*a* of the ignition lever 62 abuts against an abutment portion 64*a* of the lock member 64 and prevents depression of the valve lever 62. In this state, inadvertent ignition of the lighter is prevented.

Figure 63:
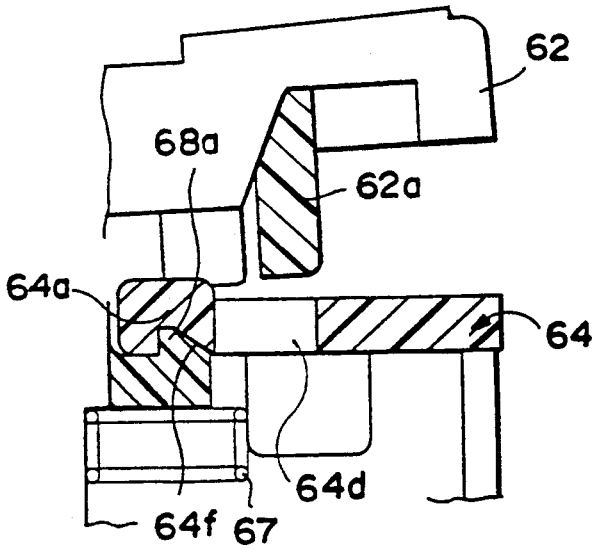
FIG. 63 is a view similar to FIG. 62 but with the lock member in the releasing position.
Figure 64:
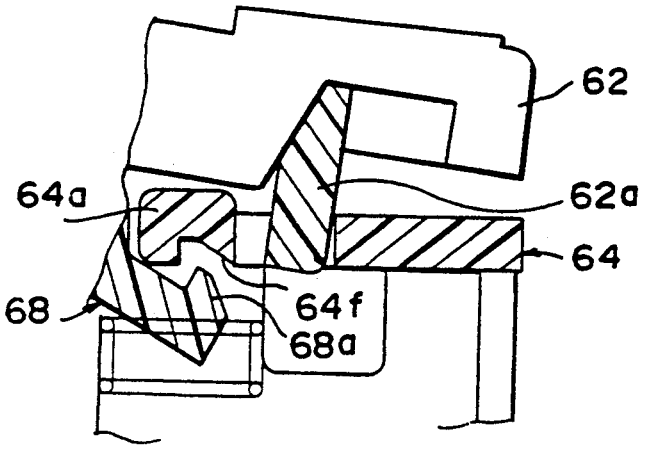
FIG. 64 is a view similar to FIG. 63 but with the ignition lever depressed.

When the lighter is used, the outer end of the lock member 64 is pushed and the lock member 64 is moved to the releasing position shown in FIG. 63, whereby depression of the valve lever 62 is permitted. When the lock member 64 is in the releasing position, an engagement protrusion 64*f* of the lock member 64 is engaged with an engagement recess 68*a* formed on a part of the holding member 68 near the intermediate casing 63*a* and the lock member 64 is held in the releasing position. When the valve lever 62 is depressed in this state, the projection 62*a* of the valve lever 62 is received in the cutaway portion 64*d* of the lock member 64 as shown in FIG. 64 and accordingly, the valve lever 62 can be moved downward, whereby release of fuel gas and actuation of the ignitor come to be possible.

Figure 65:
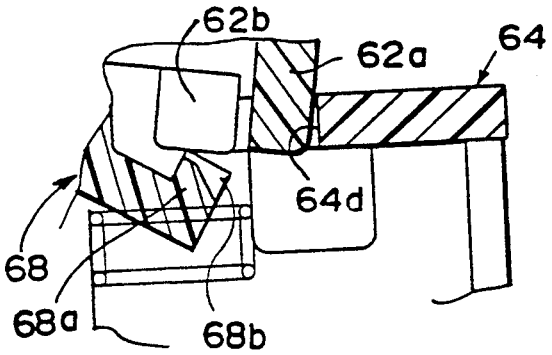
FIG. 65 is a cross-sectional view showing another part of the lighter with the valve lever depressed.
Figure 66:
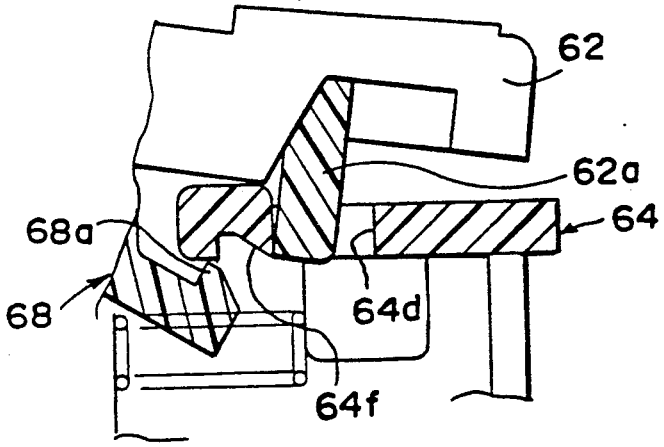
FIG. 66 is a view similar to FIG. 64 but with the lock member in the temporarily-held state.

In response to depression of the valve lever 62, the projection 62*b* on the lower surface of the valve lever 62 pushes the projection 68*b* of the holding member 68, whereby the holding member 68 is deformed downward as shown in FIG. 65 and the engagement recess 68*a* of the holding member 68 is disengaged from the engagement protrusion 64*f* of the lock member 64. Accordingly, the lock member 64 tends to return to the locking position under the force of the spring 67. However, since the projection 62*a* of the ignition lever 62 is still received in the cutaway portion 64*d* at this time and since the former is received in the latter with a slight play, the lock member 64 is moved from the releasing position toward the locking position by a small distance and is held there. That is, the lock member 64 is temporarily held in a position slightly deviated toward the locking position from the position where the engagement recess 68*a* of the holding member 68 is disengaged from the engagement protrusion 64*f* of the lock member 64 as shown in FIG. 66.

While the lock member 64 is in the temporarily held state, the lighter is ignited, and when the ignition lever 62 is released after ignition, the valve lever 62 is moved upward and the projection 62*a* of the valve lever 62 is completely removed from the cutaway portion 64*d* of the lock member 64, whereby the lock member 64 is permitted to return to the locking position under the force of the spring 67 and the whole mechanism is returned to the state shown in FIG. 62.

As can be understood from the description above, the lock member 64 prevents depression of the ignition lever 62 thereby preventing inadvertent ignition of the lighter while the lighter is not used, and the lock member 64 is automatically returned to the locking position after it is moved to the releasing position and the lighter is ignited. Thus the lock mechanism is automatically restored without operation after it is once released and the lighter is ignited. Further since the lock mechanism is arranged to be released by movement of the lock member along a linear path to the releasing position and the lock member is automatically held in the releasing position, the user can actuate the ignition lever with either the finger which has been used to release the lock mechanism or any finger else independently from action of releasing the lock mechanism. Thus, also in this embodiment, there can be provided a gas lighter with a safety device which is excellent both in ease of handling and in safety function and which can be operated steadily without depending on the person who uses it.

Figure 67:
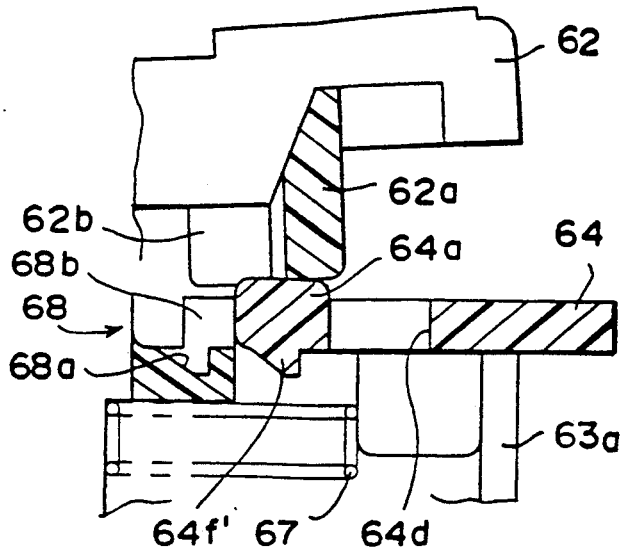
FIG. 67 is a cross-sectional view for illustrating a gas lighter with a safety device in accordance with still another embodiment of the present invention in which the relation between the engaging recess of the lock member and the engaging protrusion of the holding member is reversed.

Further the relation between the engaging recess 4*f*, 14*f* or 24*f* of the lock member 4, 14 or 24 and the engaging protrusion 8*a*, 8*a* or 28*a* of the holding member 8, 18 or 28 may be reversed. That is, the lock member may be provided with an engagement protrusion instead of the engagement recess while the holding member may be provided with an engagement recess instead of the engagement protrusion. Such an embodiment is shown in FIG. 67. In FIG. 67, the parts analogous to the parts shown in FIGS. 62 to 66 are given the same reference numerals and the engagement protrusion of the lock member 64 and the engagement recess of the holding member 68 are indicated at 64*f* and 68, respectively.

Further, though any one of the lock members 14, 24, 34, 44, 54 and 64 is movable along the upper surface of the lighter body and is pushed inward of the lighter body when it is moved to the releasing position, the lock member may be arranged to slide on a side face of the lighter body. Also in this case, the user can actuate the ignition lever with either the finger which has been used to release the lock mechanism or any finger else so long as the lock member s moved along a linear path to the releasing position. Such an embodiment is shown in FIGS. 68 to 72.

In this embodiment, the lock member is provided with a finger board portion which is slid back and forth on a side face of the lighter to move the lock member between the locking position and the releasing position, and at the same time, the lock member is connected to a cap which can be opened and closed, thereby providing higher safety. The lock member is connected to the cap so that the cap is positioned above the fuel nozzle and prevents fuel from burning when the lock member is in the locking position and is moved to a retracted position where it permits fuel to burn in response to movement of the lock member to the releasing position.

Figure 68:
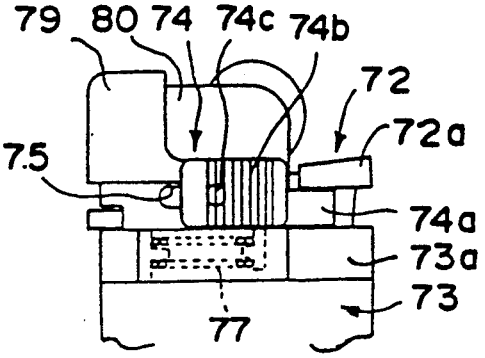
FIG. 68 is a fragmentary side view for illustrating a gas lighter with a safety device in accordance with still another embodiment of the present invention in which the lock member is arranged to slide back and forth on one side of the lighter and is connected to a cap which is opened and closed, the lock member being in the locking position.
Figure 69:
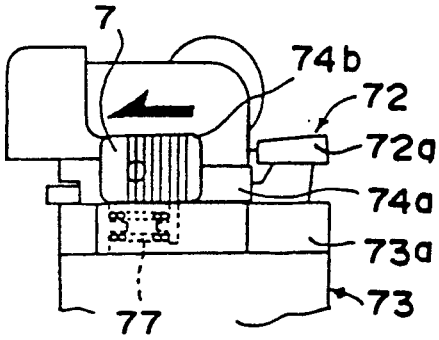
FIG. 69 is a view similar to FIG. 68 but with the lock member in the releasing position.
Figure 70:
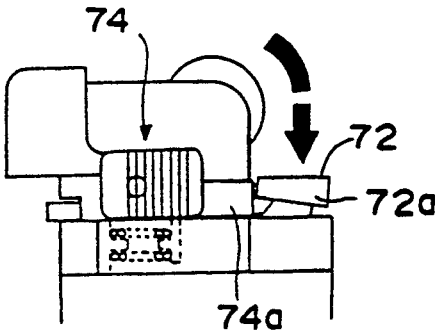
FIG. 70 is a view similar to FIG. 69 but with the valve lever depressed.
Figure 71:
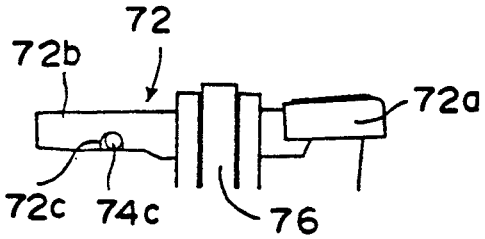
FIG. 71 is a side view showing the position of the recess of the valve lever relative to the protrusion of the lock member upon initiation of depression of the valve lever.
Figure 72:
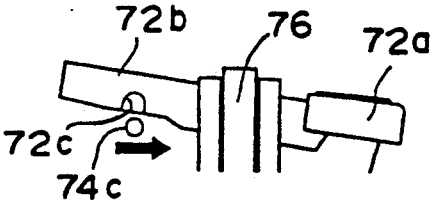
FIG. 72 is a side view showing the position of the recess of the valve lever relative to the protrusion of the lock member in the state where the valve lever has been depressed.

FIG. 68 shows the state where the lock member is in the locking position and the cap is positioned above the fuel nozzle, FIG. 69 shows the state where the lock member is in the releasing position with the cap in the retracted position, FIG. 70 shows the state where the valve lever is depressed, FIG. 71 shows the position of the recess of the ignition lever relative to the protrusion of the lock member upon initiation of depression of the ignition lever, and FIG. 72 shows the position of the recess of the ignition lever relative to the protrusion of the lock member in the state where the ignition lever has been depressed.

In this embodiment, the lock member 74 is movable back and forth on a side face of the intermediate casing 73*a* of the lighter body 73 and is connected to a cap 79 which can be opened and closed as shown in FIG. 68. The cap 79 is moved together with the lock member 74 along a windshield 80 to open and close the upper opening of the windshield 80 between a position above the above the fuel nozzle (shown in FIG. 68) where it prevents fuel from burning and a retracted position (shown in FIGS. 69–70) where it permits fuel to burn.

As shown in FIG. 68, the lock member 74 is integrally connected to the cap 79 and is provided with a pin 74*c* which is slidable engaged with an elongated hole 75 formed on the side face of the intermediate casing 73*a*. Thus, the finger board portion 74*b* of the lock member 74 is movable back and forth on the side face of the intermediate casing 73*a*. The lock member 74 has an abutment portion 74*a* which extends below the depressing portion 72*a* of the valve lever 72, and when the lighter is not used, the lock member 74 is in the locking position where the abutment portion 74*a* is positioned below the depressing portion 72*a* of the valve lever 72 and prevents depression of the valve lever 72. In this state, the lighter cannot be ignited and inadvertent ignition of the lighter is prevented.

When the lighter used, the finger board portion 74*b* of the lock member 74 is pushed leftward to move the lock member 74 from the locking position to the releasing position shown in FIG. 69 where the abutment portion 74*a* of the lock member 74 is retracted away from below the depressing portion 72*a* of the valve lever 72, thereby permitting depression of the ignition lever 72 as shown in FIG. 70.

In the releasing position, the pin 74*c* of the lock member 74 is engaged with an engagement cutaway portion 72*c* which is formed on the lower surface of an arm portion 72*b* of the valve lever 72 which is on the side of a column 76 opposite to the side of the depressing portion 72*a* as shown in FIG. 71, the column 76 being for supporting depression of the ignition lever 72. The lock member 74 is held in the releasing position by the engagement between the pin 74*c* and the cutaway portion 72*c*. When the depressing portion 72*a* of the ignition lever 72 is depressed in this state, the pin 74*c* of the lock member 74 is disengaged from the cutaway portion 72*c* of the valve 72 and the lock member 74 moves rightward under the force of the spring 77 as shown in FIG. 72. Thus the lock member 74 is released from the releasing position and tends to return to the locking position. However since the abutment portion 74*a* of the lock member 74 abuts against the depressing portion 72*a* of the valve lever 72, the lock member 74 is temporarily held in a position slightly deviated toward the locking position from releasing position.

While the lock member 74 is in the temporarily held state, the lighter is ignited, and when the valve lever 72 is released after ignition, the valve lever 72 is moved upward and the abutment portion 74*a* of the lock member 74 moves below the depressing portion 72*a* of the valve lever 72, whereby the lock member 74 is permitted to return to the locking position under the force of the spring 77 and the whole mechanism is returned to the state shown in FIG. 68.

As can be understood from the description above, the lock member 74 prevents depression of the valve lever 72 thereby preventing inadvertent ignition of the lighter while the lighter is not used, and the lock member 74 is automatically returned to the locking position after it is moved to the releasing position and the lighter is ignited. Thus the lock mechanism is automatically restored without operation after it is once released and the lighter is ignited. Further since the lock mechanism is arranged to be released by movement of the lock member along a linear path to the releasing position and the lock member is automatically held in the releasing position, the user can actuate the valve lever with either the finger which has been used to release the lock mechanism or any finger else independently from action of releasing the lock mechanism. Thus, also in this embodiment, there can be provided a gas lighter with a safety device which is excellent both in ease of handling and in safety function and which can be operated steadily without depending on the person who uses it.

Though, in the embodiment described above, the pin 74*c* doubles a means which is engaged with the elongated hole 75 and guides slide of the lock member 74 with a means which is engaged with the cutaway portion 72*c* of the valve lever 72 and holes the lock member 74 in the releasing position, the two means may be separately formed.

As will be apparent from the description above, the present invention can be embodied in various ways and the embodiments described may be modified into number of forms.

In the gas lighter in accordance with the present invention, the ignition mechanism need not be limited to the flint type but may be of any type, e.g., a piezoelectric type or an electronic type.

What is claimed is:

1. A gas lighter with a safety device comprising a lighter body having a fuel reservoir in which fuel to be ignited is stored and a fuel supply means which supplies fuel from the fuel reservoir at a regulated flow rate, an ignition means for igniting the supplied fuel, and an actuating lever which is depressed to actuate the fuel supply means to supply fuel, characterized by having a lock member which is able to linearly move between a locking position where it prevents depression of the actuating lever and a releasing position where it allows depression of the actuating lever and is urged to the locking position, a holding means which holds the lock member in the releasing position in response to movement of the lock member to the releasing position, a releasing means which releases the lock member from the holding means in response to depression of the actuating lever, thereby permitting the lock member to move away from the releasing position, and a temporary holding means which temporarily holds the lock member in the releasing position or the vicinity thereof until the actuating lever returns to the original position after it is depressed.

2. A gas lighter with a safety device as defined in claim 1 in which said lock member is slid under the guidance of a groove formed on the lighter body.

3. A gas lighter with a safety device as defined in claim 1 in which said lock member has an outer end portion which projects outside the lighter body when the lock member is in the locking position and is foldable when the lock member is in the locking position.

4. A gas lighter with a safety device as defined in claim 1 in which at least a part of the lock member is formed of resilient material and the part formed of the resilient material forms a means for urging the lock member to the locking position.

5. A gas lighter with a safety device as defined in claim 1 in which said lock member is urged to the locking position by a spring separate from the lock member.

6. A gas lighter with a safety device as defined in claim 1 in which said holding means comprises a first engagement portion formed in the lock member and a second engagement portion formed on the lighter body to be resiliently engaged with the first engagement portion.

7. A gas lighter with a safety device as defined in claim 6 in which said releasing means resiliently deforms one of the first and second engagement portions to release the lock member from the holding means in response to depression of the actuating lever.

8. A gas lighter with a safety device as defined in claim 1 in which said temporary holding means comprises an engagement portion formed on the actuating lever and an engagement portion which is formed on the lock member, to be engaged with the engagement portion formed on the actuating lever.

9. A gas lighter with a safety device as defined in claim 1 in which said lock member has an outer end portion which projects outside the lighter body when the lock member is in the locking position and the lock member is moved from the locking position to the releasing position by pushing the outer end portion into the lighter body.

10. A gas lighter with a safety device as defined in claim 1 in which said lock member has a finger board portion which is slidable along a side face of the lighter body and the lock member is moved from the locking position to the releasing position by sliding the finger board portion along the side face of the lighter body.

11. A gas lighter with a safety device as defined in claim 1 further comprising a burning preventing means which prevents said fuel from burning, the burning preventing means being connected to said lock member so that the burning preventing means is positioned in a first position where it prevents the fuel from burning when the lock member is in the locking position and moved to a second position where it permits the fuel to burn in response to movement of the lock member from the locking position to the releasing position.

12. A gas lighter with a safety device as defined in claim 11 in which said burning preventing means is in the form of a cover which is positioned above a fuel nozzle of the fuel supply means to prevent said fuel from burning.

13. A gas lighter with a safety device comprising a lighter body having a fuel reservoir and a fuel supply means which is mounted on the fuel reservoir and supplies fuel from the fuel reservoir at a regulated flow rate, and an intermediate casing provided with an ignition means for igniting the supplied fuel and an actuating lever which is depressed to actuate the fuel supply means to supply fuel, characterized by having a lock member which is mounted on said intermediate casing to be able to linearly side between a locking position where it prevents depression of the actuating lever and a releasing position where it allows depression of the actuating lever and is urged by resilient means to the locking position, a holding means which holds the lock member in the releasing position in response to movement of the lock member to the releasing position, a releasing means which releases the lock member from the holding means in response to depression of the actuating lever, thereby permitting the lock member to move away from the releasing position, and a temporary holding means which temporarily holds the lock member in the releasing position or the vicinity thereof until the actuating lever returns to the original position after it is depressed.

14. A gas lighter with a safety device as defined in claim 13 in which said holding means comprises a first engagement portion formed in the lock member and a second engagement portion formed on the intermediate casing to be resiliently engaged with the first engagement portion.

15. A gas lighter with a safety device as defined in claim 13 in which said temporary holding means comprises an engagement portion formed on the lock member and an engagement portion which is formed on the actuating lever to be engaged with the engagement portion formed on the lock member.

16. A gas lighter with a safety device comprising, a fuel reservoir in which fuel to be ignited is stored, a fuel supply means which supplies fuel from the fuel reservoir at a regulated flow rate, an ignition means for igniting the supplied fuel, a valve lever which is depressed to actuate the fuel supply means, a lighter body provided therein with said fuel reservoir and with said fuel supply means, the ignition means and the valve lever on the upper portion thereof, a lock member which is able to slide along a linear groove formed on the upper portion of the lighter body between a locking position and a releasing position, the lock member being provided with an abutment surface which abuts against a lower surface of the valve lever to prevent depression of the valve lever when the lock member is in the locking position and is retracted away from the lower surface of the valve lever to permit depression of the valve lever when the lock member is in the releasing position, an urging means which resiliently urges the lock member to the locking position, a holding member which is resiliently deformable and has an engagement portion which is provided near the linear groove on the lighter body and is resiliently engaged with one part of the lock member to hold the lock member in the releasing position in response to movement of the lock member to the releasing position, a releasing projection which is provided on the valve lever and abuts against a part of the holding member to deform the holding member thereby releasing the lock member from the engagement portion of the holding member in response to depression of the valve lever, and a temporary holding projection which is provided on the valve lever and engages with said one part of the lock member to temporarily hold the lock member in the releasing position or the vicinity thereof until the valve lever returns to the original position after it is depressed.

17. A gas lighter with a safety device as defined in claim 16 in which said engagement portion of the holding member which is resiliently engaged with said one part of the lock member to hold the lock member in the releasing position is in the form of a projection and said one part of the lock member is in the form of a recess.

18. A gas lighter with a safety device as defined in claim 16 in which said engagement portion of the holding member which is resiliently engaged with said one part of the lock member to hold the lock member in the releasing position is in the form of a recess and said one part of the lock member is in the form of a protrusion.

19. A gas lighter with a safety device as defined in claim 16 in which said one part of the lock member which engages with said temporary holding projection to temporarily hold the lock member in the releasing position or the vicinity thereof until the valve lever returns to the original position after it is depressed is a cutaway portion.

20. A gas lighter with a safety device as defined in claim 16 in which a pair of temporary holding projections are provided on the valve lever and engage with said one part of the lock member to temporarily hold the lock member in the releasing position or the vicinity thereof until the valve lever returns to the original position after it is depressed.

21. A gas lighter with a safety device as defined in claim 16 in which said lower surface of the valve lever which abuts against the abutment surface of the lock member when the lock member is in the locking position doubles as the lower surface of said temporary holding projection which is provided on the valve lever and engages with said one part of the lock member to temporarily hold the lock member in the releasing position or the vicinity thereof.

22. A gas lighter with a safety device comprising, a fuel reservoir in which fuel to be ignited is stored, a valve means which supplies fuel from the fuel reservoir at a regulated flow rate, an ignition mechanism for igniting the supplied fuel, a valve lever (12) which is depressed to actuate the valve means to supply fuel, an intermediate casing (13*a*) provided with the ignition mechanism and the valve lever (12) on the upper portion thereof, a lock member (14) which is able to slide along a linear groove (13*b*) formed on the upper portion of the intermediate casing (13*a*) between a locking position and a releasing position, the lock member (14) being provided with an abutment surface (14*c*) which abuts against a temporary holding projection (12*a*) formed on the lower surface of the valve lever (12) to prevent depression of the valve lever (12) when the lock member (14) is in the locking position and is retracted away from the temporary holding projection (12*a*) of the valve lever (12) to permit depression of the valve lever (12) when the lock member (14) is in the releasing position, a spring (15) which is compressed between a hook (14*e*) formed on the lock member (14) and a vertical wall portion (13*c*) of the intermediate casing (13*a*) and resiliently urges the lock member (14) to the locking position, a resiliently deformable holding member (18) which is provided on the vertical wall portion (13*c*) of the intermediate casing (13*a*) and has an engagement portion (18*a*) which is resiliently engaged with an engagement portion (14*f*) of the lock member (14) to hold the lock member (14) in the releasing position in response to movement of the lock member (14) to the releasing position, and a releasing projection (12*b*) which is provided on the lower surface of the valve lever (12) and abuts against a projection (18*b*) on the holding member (18) to deform the holding member (18) thereby releasing the lock member (14) from the engagement portion (18*a*) of the holding member (18) in response to depression of the valve lever (12), said temporary holding projection (12*a*) engaging with a cutaway portion (14*d*) of the lock member (14) to temporarily hold the lock member (14) in the releasing position or the vicinity thereof until the valve lever (12) returns to the original position after it is depressed.

23. A gas lighter with a safety device as defined in claim 22 in which said valve lever (12) is formed of resin material having high resistance to heat and is provided with a depressing portion (12*c*) for depressing the valve lever (12) at one end thereof, an engagement portion which is engaged with said valve means at the other end thereof and said temporary holding projection (12*a*) and a pair of said releasing projections (12*b*) on the lower surface thereof.

24. A gas lighter with a safety device as defined in claim 23 in which said lock member (14) is provided, adjacent to said abutment surface (14*c*) which abuts against a pair of said temporary holding projections (12*a*), with a pair of cutaway portions (14*d*) in which said pair of temporary holding projections (12*a*) are respectively received.

25. A gas lighter with a safety device as defined in claim 22 in which said lock member (14) is formed of highly slidable resin material and is provided on its lower surface with said hook (14*e*), the hook (14*e*) being slidably engaged with said linear groove (13*b*) on the intermediate casing (13*c*) and guides the lock member (14) on the intermediate casing (13*c*), and said hook (14*e*) is provided with a spring retaining surface (14*h*) on the surface opposed to the vertical wall portion (13*c*) of the intermediate casing (13*a*), said spring (15) being retained between the vertical wall portion (13*c*) and the spring retaining surface (14*h*).

26. A gas lighter with a safety device as defined in claim 22 in which said holding member (18) is formed in a part of the intermediate casing (13*a*) of the lighter body (13) and is in the form of a cantilever-like arm (18*c*) which extends horizontally, and said engagement portion (18*a*) which engages with the engagement portion (14*f*) of the lock member (14) and holds the lock member (14) in the releasing position and said projection (18*b*) which is pressed by the releasing projection (12*b*) of the valve lever (12) and releases engagement portion (14*f*) of the lock member (14) from the engagement portion (18*a*) of the holding member (18) in response to depression of the valve lever (12) are formed on the a cantilever-like arm (18*c*).

* * * * *

UNITED STATES PATENT AND TRADEMARK OFFICE

CERTIFICATE OF CORRECTION

PATENT NO. : 5,186,618

DATED : February 16, 1993

INVENTOR(S) : Tsutomu Shike et al.

It is certified that error appears in the above-identified patent and that said Letters Patent is hereby corrected as shown below: Title page:

Item (30): 2nd column, 2nd line: The number "62-080244" should read --62-180244--.

Column 1, line 53: The number "-1050" should read -- -501050--.

Column 9, line 67: The words "may be" should read --may be arranged to be slidable in the longitudinal direction--.

Column 10, lines 9-10: Delete "by a conventional mechanism (not shown)".

Column 14, line 67: The numbers "8a, 8a" should read --8a, 18a--.

Column 15, line 9: The number "68" should read --68a--.

Signed and Sealed this

Fifteenth Day of March, 1994

Bruce Lehman

*Attest:*

BRUCE LEHMAN

*Attesting Officer*

*Commissioner of Patents and Trademarks*